US010743588B2

(12) United States Patent
Ampolini et al.

(10) Patent No.: US 10,743,588 B2
(45) **Date of Patent: *Aug. 18, 2020**

(54) AEROSOL DELIVERY DEVICE INCLUDING A WAVE GUIDE AND RELATED METHOD

(71) Applicant: RAI Strategic Holdings, Inc., Winston-Salem, NC (US)

(72) Inventors: Frederic Philippe Ampolini, Winston-Salem, NC (US); Wilson Christopher Lamb, Hillsborough, NC (US); Michael Pail, Cary, NC (US)

(73) Assignee: RAI STRATEGIC HOLDINGS, INC., Winston-Salem, NC (US)

( * ) Notice: Subject to any disclaimer, the term of this patent is extended or adjusted under 35 U.S.C. 154(b) by 176 days.

This patent is subject to a terminal disclaimer.

(21) Appl. No.: 15/964,543

(22) Filed: Apr. 27, 2018

(65) Prior Publication Data

US 2018/0271157 A1 Sep. 27, 2018

Related U.S. Application Data

(63) Continuation of application No. 14/642,241, filed on Mar. 9, 2015, now Pat. No. 9,980,516.

(51) Int. Cl.
*A24F 47/00* (2020.01)
*H05B 3/00* (2006.01)

(52) U.S. Cl.
CPC ..... *A24F 47/008* (2013.01); *H05B 3/0033* (2013.01)

(58) Field of Classification Search
CPC ..... A61M 15/06; A61M 15/0001; A61M 11/042; H05B 3/0033; A24F 47/002;
(Continued)

(56) References Cited

U.S. PATENT DOCUMENTS 1,771,366 A 7/1930 Wyss et al.
2,057,353 A 10/1936 Whittemore, Jr.
(Continued)

FOREIGN PATENT DOCUMENTS

AU 276250 7/1965
CA 2 641 869 5/2010
(Continued)

OTHER PUBLICATIONS

Fuji Polymer Industries Co., Ltd; Products; Light Guide Film (LGF); website visited Mar. 13, 2015 (3 pgs.) http://www.fujipoly.co.jp/english/products/other_04/.
(Continued)

*Primary Examiner* — Brian W Jennison
(74) *Attorney, Agent, or Firm* — Womble Bond Dickinson (US) LLP

(57) ABSTRACT

The present disclosure relates to aerosol delivery devices that may include components configured to convert electrical energy to heat and atomize an aerosol precursor composition. An outer body may at least partially enclose the components. An illumination source may be configured to output electromagnetic radiation. A wave guide may be configured to receive the electromagnetic radiation from the illumination source and illuminate the aerosol delivery device. The wave guide may define an increasing width from a first longitudinal end at which the electromagnetic radiation is received to an opposing second longitudinal end. Thereby, the wave guide may directly transmit the electromagnetic radiation across the entirety of the second longitudinal end to provide substantially even illumination at the second longitudinal end while employing less material and reducing the volume of space occupied by the wave guide as compared to cylindrical embodiments of wave guides. Related methods are also provided.

24 Claims, 19 Drawing Sheets

(58) Field of Classification Search
CPC ..... A24F 47/008; F21V 33/00; F21V 33/004; F21V 7/22
See application file for complete search history.

(56) References Cited

U.S. PATENT DOCUMENTS 2,104,266 A 1/1938 McCormick
3,200,819 A 8/1965 Gilbert
4,284,089 A 8/1981 Ray
4,303,083 A 12/1981 Burruss, Jr.
4,735,217 A 4/1988 Gerth et al.
4,848,374 A 7/1989 Chard et al.
4,907,606 A 3/1990 Lilja et al.
4,922,901 A 5/1990 Brooks et al.
4,945,931 A 8/1990 Gori
4,947,874 A 8/1990 Brooks et al.
4,947,875 A 8/1990 Brooks et al.
4,986,286 A 1/1991 Roberts et al.
4,987,908 A 1/1991 Sprinkel et al.
5,019,122 A 5/1991 Clearman et al.
5,042,510 A 8/1991 Curtiss et al.
5,060,671 A 10/1991 Counts et al.
5,093,894 A 3/1992 Deevi et al.
5,144,962 A 9/1992 Counts et al.
5,154,192 A 10/1992 Sprinkel et al.
5,249,586 A 10/1993 Morgan et al.
5,261,424 A 11/1993 Sprinkel, Jr.
5,269,327 A 12/1993 Counts et al.
5,322,075 A 6/1994 Deevi et al.
5,353,813 A 10/1994 Deevi et al.
5,369,723 A 11/1994 Counts et al.
5,372,148 A 12/1994 McCafferty et al.
5,388,574 A 2/1995 Ingebrethsen et al.
5,408,574 A 4/1995 Deevi et al.
5,468,936 A 11/1995 Deevi et al.
5,498,850 A 3/1996 Das
5,515,842 A 5/1996 Ramseyer et al.
5,530,225 A 6/1996 Hajaligol
5,564,442 A 10/1996 MacDonald et al.
5,649,554 A 7/1997 Sprinkel et al.
5,666,977 A 9/1997 Higgins et al.
5,687,746 A 11/1997 Rose et al.
5,726,421 A 3/1998 Fleischhauer et al.
5,727,571 A 3/1998 Meiring et al.
5,799,663 A 9/1998 Gross et al.
5,819,756 A 10/1998 Mielordt
5,865,185 A 2/1999 Collins et al.
5,865,186 A 2/1999 Volsey, II
5,878,752 A 3/1999 Adams et al.
5,894,841 A 4/1999 Voges
5,934,289 A 8/1999 Watkins et al.
5,954,979 A 9/1999 Counts et al.
5,967,148 A 10/1999 Harris et al.
6,040,560 A 3/2000 Fleischhauer et al.
6,053,176 A 4/2000 Adams et al.
6,089,857 A 7/2000 Matsuura et al.
6,095,153 A 8/2000 Kessler et al.
6,125,853 A 10/2000 Susa et al.
6,155,268 A 12/2000 Takeuchi
6,164,287 A 12/2000 White
6,196,218 B1 3/2001 Voges
6,196,219 B1 3/2001 Hess et al.
6,598,507 B1 7/2003 Adiga et al.
6,601,776 B1 8/2003 Oljaca et al.
6,615,840 B1 9/2003 Fournier et al.
6,688,313 B2 2/2004 Wrenn et al.
6,772,756 B2 8/2004 Shayan
6,803,545 B2 10/2004 Blake et al.
6,854,461 B2 2/2005 Nichols
6,854,470 B1 2/2005 Pu
7,117,867 B2 10/2006 Cox et al.
7,293,565 B2 11/2007 Griffin et al.
7,513,253 B2 4/2009 Kobayashi et al.
7,775,459 B2 8/2010 Martens, III et al.
7,832,410 B2 11/2010 Hon
7,845,359 B2 12/2010 Montaser
7,896,006 B2 3/2011 Hamano et al.
8,127,772 B2 3/2012 Montaser
8,178,852 B2 5/2012 Kingsley et al.
8,232,533 B2 7/2012 Kingsley et al.
8,314,591 B2 11/2012 Terry et al.
8,365,742 B2 2/2013 Hon
8,402,976 B2 3/2013 Fernando et al.
8,499,766 B1 8/2013 Newton
8,528,569 B1 9/2013 Newton
8,539,959 B1 9/2013 Scatterday
8,550,069 B2 10/2013 Alelov
2002/0146242 A1 10/2002 Vieira
2003/0226837 A1 12/2003 Blake et al.
2004/0118401 A1 6/2004 Smith et al.
2004/0129280 A1 7/2004 Woodson et al.
2004/0200488 A1 10/2004 Felter et al.
2004/0226568 A1 11/2004 Takeuchi et al.
2005/0016550 A1 1/2005 Katase
2006/0016453 A1 1/2006 Kim
2006/0196518 A1 9/2006 Hon
2007/0074734 A1 4/2007 Braunshteyn et al.
2007/0102013 A1 5/2007 Adams et al.
2007/0215167 A1 9/2007 Crooks et al.
2008/0085103 A1 4/2008 Beland et al.
2008/0092912 A1 4/2008 Robinson et al.
2008/0257367 A1* 10/2008 Paterno ..... A24F 47/008 131/328
2008/0276947 A1 11/2008 Martzel
2008/0302374 A1 12/2008 Wengert et al.
2009/0095311 A1 4/2009 Hon
2009/0095312 A1 4/2009 Herbrich et al.
2009/0126745 A1 5/2009 Hon
2009/0188490 A1 7/2009 Hon
2009/0230117 A1 9/2009 Fernando et al.
2009/0272379 A1 11/2009 Thorens et al.
2009/0283103 A1 11/2009 Nielsen et al.
2009/0320863 A1 12/2009 Fernando et al.
2010/0043809 A1 2/2010 Magnon
2010/0083959 A1 4/2010 Siller
2010/0200006 A1 8/2010 Robinson et al.
2010/0229881 A1 9/2010 Hearn
2010/0242974 A1 9/2010 Pan
2010/0307518 A1 12/2010 Wang
2010/0313901 A1 12/2010 Fernando et al.
2011/0005535 A1 1/2011 Xiu
2011/0011396 A1 1/2011 Fang
2011/0036363 A1 2/2011 Urtsev et al.
2011/0036365 A1 2/2011 Chong et al.
2011/0094523 A1 4/2011 Thorens et al.
2011/0126848 A1 6/2011 Zuber et al.
2011/0155153 A1 6/2011 Thorens et al.
2011/0155718 A1 6/2011 Greim et al.
2011/0168194 A1 7/2011 Hon
2011/0265806 A1 11/2011 Alarcon et al.
2011/0277761 A1* 11/2011 Terry ..... A24F 47/008 128/203.12
2011/0309157 A1 12/2011 Yang et al.
2012/0042885 A1 2/2012 Stone et al.
2012/0060853 A1 3/2012 Robinson et al.
2012/0080613 A1 4/2012 Kingsley et al.
2012/0111347 A1 5/2012 Hon
2012/0132643 A1 5/2012 Choi et al.
2012/0227752 A1 9/2012 Alelov
2012/0231464 A1 9/2012 Yu et al.
2012/0260927 A1 10/2012 Liu
2012/0279512 A1 11/2012 Hon
2012/0318882 A1 12/2012 Abehasera
2013/0037041 A1 2/2013 Worm et al.
2013/0040011 A1 2/2013 Wu et al.
2013/0042865 A1 2/2013 Monsees et al.
2013/0056013 A1 3/2013 Terry et al.
2013/0081625 A1 4/2013 Rustad et al.
2013/0081642 A1 4/2013 Safari
2013/0088853 A1 4/2013 Kingsley et al.
2013/0192619 A1 8/2013 Tucker et al.
2013/0255702 A1 10/2013 Griffith, Jr. et al.
2013/0306084 A1 11/2013 Flick
2013/0312742 A1 11/2013 Monsees et al.

(56) References Cited

U.S. PATENT DOCUMENTS

| | | | |
|---|---|---|---|
| 2013/0319439 | A1 | 12/2013 | Gorelick et al. |
| 2013/0340750 | A1 | 12/2013 | Thorens et al. |
| 2013/0340775 | A1 | 12/2013 | Juster et al. |
| 2014/0000638 | A1 | 1/2014 | Sebastian et al. |
| 2014/0060554 | A1 | 3/2014 | Collett et al. |
| 2014/0060555 | A1 | 3/2014 | Chang et al. |
| 2014/0096781 | A1 | 4/2014 | Sears et al. |
| 2014/0096782 | A1 | 4/2014 | Ampolini et al. |
| 2014/0109921 | A1 | 4/2014 | Chen |
| 2014/0157583 | A1 | 6/2014 | Ward et al. |
| 2014/0209105 | A1 | 7/2014 | Sears et al. |
| 2014/0246018 | A1 | 9/2014 | Terry et al. |
| 2014/0253144 | A1 | 9/2014 | Novak et al. |
| 2014/0261408 | A1 | 9/2014 | DePiano et al. |
| 2014/0261486 | A1 | 9/2014 | Potter et al. |
| 2014/0261487 | A1 | 9/2014 | Chapman et al. |
| 2014/0261495 | A1 | 9/2014 | Novak et al. |
| 2014/0270727 | A1 | 9/2014 | Ampolini et al. |
| 2014/0270729 | A1 | 9/2014 | DePiano et al. |
| 2014/0270730 | A1 | 9/2014 | DePiano et al. |
| 2014/0311503 | A1 | 10/2014 | Liu |
| 2014/0345631 | A1 | 11/2014 | Bowen et al. |
| 2015/0208729 | A1 | 7/2015 | Monsees et al. |
| 2015/0216233 | A1 | 8/2015 | Sears et al. |

FOREIGN PATENT DOCUMENTS

| | | |
|---|---|---|
| CN | 1541577 | 11/2004 |
| CN | 2719043 | 8/2005 |
| CN | 200997909 | 1/2008 |
| CN | 101116542 | 2/2008 |
| CN | 101176805 | 5/2008 |
| CN | 201379072 | 1/2010 |
| CN | 203388262 | 1/2014 |
| DE | 10 2006 004 484 | 8/2007 |
| DE | 102006041042 | 3/2008 |
| DE | 20 2009 010 400 | 11/2009 |
| EP | 0 295 122 | 12/1988 |
| EP | 0 430 566 | 6/1991 |
| EP | 0 845 220 | 6/1998 |
| EP | 1 618 803 | 1/2006 |
| EP | 2 316 286 | 5/2011 |
| GB | 2469850 | 11/2010 |
| WO | WO 1997/48293 | 12/1997 |
| WO | WO 2004/043175 | 5/2004 |
| WO | WO 2004/080216 | 9/2004 |
| WO | WO 2005/099494 | 10/2005 |
| WO | WO 2007/078273 | 7/2007 |
| WO | WO 2007/131449 | 11/2007 |
| WO | WO 2009/105919 | 9/2009 |
| WO | WO 2009/155734 | 12/2009 |
| WO | WO 2010/003480 | 1/2010 |
| WO | WO 2010/045670 | 4/2010 |
| WO | WO 2010/073122 | 7/2010 |
| WO | WO 2010/118644 | 10/2010 |
| WO | WO 2010/140937 | 12/2010 |
| WO | WO 2011/010334 | 1/2011 |
| WO | WO 2012/072762 | 6/2012 |
| WO | WO 2012/100523 | 8/2012 |
| WO | WO 2013/089551 | 6/2013 |
| WO | WO 2013/141907 | 9/2013 |
| WO | WO 2014/040217 | 3/2014 |

OTHER PUBLICATIONS

Lumatec; Lumatec Liquid Light Guides; website visited Mar. 17, 2015 (7 pgs.) http://www.lumatec.de/liquid_light_guides/e_overview.htm.

Planetech International; Light Guide Films and Backlights; website visited Mar. 13, 2015 (2 pgs.) http://www.lightguide.planetechn.com/.

Kuraray; News Releases 2009; Kuraray to Launch the Energy-Saving, Thin, Edge-Light System Light Guide Panel for LED Sign Boards; website visited Mar. 13, 2015 (3 pgs.) http://www.kuraray.co.jp/en/release/2009/090512.html.

Lumvatech; website visited Mar. 17, 2015 (4 pgs.) www.lumvatech.com.

RP Photonics Encyclopedia, "*Waveguides*", website visited Feb. 5, 2014 http://www.rp-photonics.com/waveguides.html.

AIPIA Active & Intelligent Packaging Industry Association, "*Transparent Aluminum Foil from Nano Plastic Layer*", website visited Feb. 5, 2014 http://www.aipia.info/news_260_transparent-aluminium-foil-from-nano-plastic-layer.php.

International Search Report dated May 23, 2016 for International Application No. PCT/US2016/021387.

* cited by examiner

AEROSOL DELIVERY DEVICE INCLUDING A WAVE GUIDE AND RELATED METHOD

CROSS-REFERENCE TO RELATED APPLICATIONS

This application is a continuation of U.S. patent application Ser. No. 14/642,241, filed Mar. 9, 2015, which is hereby incorporated by reference in its entirety in this application.

FIELD OF THE DISCLOSURE

The present disclosure relates to an aerosol delivery device, and more particularly to providing illumination at an outer surface of the aerosol delivery device. The aerosol delivery device may be configured to heat an aerosol precursor, which may be made or derived from tobacco or otherwise incorporate tobacco, to form an inhalable substance for human consumption.

BACKGROUND

Many smoking devices have been proposed through the years as improvements upon, or alternatives to, smoking products that require combusting tobacco for use. Many of those devices purportedly have been designed to provide the sensations associated with cigarette, cigar, or pipe smoking, but without delivering considerable quantities of incomplete combustion and pyrolysis products that result from the burning of tobacco. To this end, there have been proposed numerous smoking products, flavor generators, and medicinal inhalers that utilize electrical energy to vaporize or heat a volatile material, or attempt to provide the sensations of cigarette, cigar, or pipe smoking without burning tobacco to a significant degree. See, for example, the various alternative smoking articles, aerosol delivery devices and heat generating sources set forth in the background art described in U.S. Pat. No. 8,881,737 to Collett et al.; U.S. Pat. App. Pub. No. 2013/0255702 to Griffith Jr. et al., U.S. Pat. App. Pub. No. 2014/0000638 to Sebastian et al., U.S. Pat. App. Pub. No. 2014/0096781 to Sears et al., U.S. Pat. App. Pub. No. 2014/0096782 to Ampolini et al., and U.S. patent application Ser. No. 14/011,992 to Davis et al., filed Aug. 28, 2013, which are incorporated herein by reference in their entireties. See also, for example, the various embodiments of products and heating configurations described in the background sections of U.S. Pat. No. 5,388,594 to Counts et al. and U.S. Pat. No. 8,079,371 to Robinson et. al, which are incorporated by reference in their entireties.

However, it may be desirable to distinguish aerosol delivery devices from that of competing products, for example, by providing aerosol delivery devices with distinguishing visual characteristics. Further, it may be desirable to configure the aerosol delivery devices to provide visual feedback or information relating to use thereof. Accordingly, it may additionally be desirable to provide components configured to illuminate aerosol delivery devices in one or more manners.

BRIEF SUMMARY OF THE DISCLOSURE

In one aspect an aerosol delivery device is provided. The aerosol delivery device may include an outer body extending between a first outer body end and a second outer body end. The outer body may be at least partially hollow and define an inner circumference. The aerosol delivery device may additionally include an illumination source configured to output an electromagnetic radiation. The illumination source may be positioned proximate the first outer body end. Further, the aerosol delivery device may include a wave guide received within the outer body. The wave guide may define a longitudinal length extending between a first longitudinal end positioned proximate the illumination source and a second longitudinal end, and a width extending transversely to the longitudinal length between a first lateral end and a second lateral end. The wave guide may extend around substantially an entirety of the inner circumference of the outer body such that the first lateral end abuts or overlaps the second lateral end along at least a portion of the longitudinal length of the wave guide. The wave guide may be configured to receive the electromagnetic radiation from the illumination source and output light at one or more illumination sections.

In some embodiments the width of the wave guide may be greater at the second longitudinal end than at the first longitudinal end. The wave guide may define a T-shape prior to insertion within the outer body. The wave guide may define a truncated triangular shape prior to insertion into the outer body. The aerosol delivery device may further include an electrical power source and a control component. The control component may be configured to direct current from the electrical power source to an atomizer.

In some embodiments the wave guide may be flexible. The wave guide may include a sheet of material wrapped into a substantially tubular configuration. The wave guide may define an outer diameter substantially equal to an inner diameter of the outer body.

In some embodiments the aerosol delivery device may additionally include a coupler coupled to the first outer body end and an end cap coupled to the second outer body end. The second longitudinal end of the wave guide may be positioned proximate the end cap. Further, the aerosol delivery device may include a cartridge. The outer body, the coupler, the end cap, the illumination source, and the wave guide may collectively define a control body, and the cartridge may be configured to engage the coupler of the control body. The one or more illumination sections may include the second longitudinal end of the wave guide. The one or more illumination sections may include an intermediate illumination section positioned between the first longitudinal end and the second longitudinal end of the wave guide.

In an additional aspect a method for assembling an aerosol delivery device is provided. The method may include coupling an illumination source to a first longitudinal end of a wave guide. The wave guide may define a longitudinal length extending between the first longitudinal end and a second longitudinal end, and a width extending transversely to the longitudinal length between a first lateral end and a second lateral end. The wave guide may be configured to receive the electromagnetic radiation from the illumination source and output light at one or more illumination sections. Further, the method may include inserting the wave guide within an outer body. The outer body may be at least partially hollow and may define an inner circumference. The wave guide may extend around substantially an entirety of the inner circumference of the outer body and the first lateral end may abut or overlap the second lateral end along at least a portion of the longitudinal length of the wave guide.

In some embodiments the method may additionally include bending the wave guide. The width of the wave guide may be greater at the second longitudinal end than at the first longitudinal end. Bending the wave guide may include abutting or overlapping the first lateral end and the second lateral end at the second longitudinal end of the wave guide. Bending the wave guide may include bending the wave guide from a T-shape. Bending the wave guide may include bending the wave guide from a truncated triangular shape. Bending the wave guide may include wrapping a sheet of material into a substantially tubular configuration such that the wave guide defines an outer diameter substantially equal to an inner diameter of the outer body.

In some embodiments the method may additionally include inserting an electrical power source and a control component within the outer body. The control component may be configured to direct current from the electrical power source to an atomizer. Further, the method may include coupling a coupler to a first outer body end and coupling an end cap to a second outer body end. The second longitudinal end of the wave guide may be positioned proximate the end cap. The method may additionally include coupling the coupler to a cartridge.

In some embodiments inserting the wave guide within the outer body may include resiliently pressing the wave guide against the inner circumference of the outer body. Coupling the illumination source to the first longitudinal end of the wave guide may include orienting the illumination source perpendicularly to the second longitudinal end of the wave guide such that the one or more illumination sections include the second longitudinal end. Further, the method may include engaging a refractor with a core of the wave guide between the first longitudinal end and the second longitudinal end of the wave guide to define an intermediate illumination section.

These and other features, aspects, and advantages of the disclosure will be apparent from a reading of the following detailed description together with the accompanying drawings, which are briefly described below. The invention includes any combination of two, three, four, or more of the above-noted embodiments as well as combinations of any two, three, four, or more features or elements set forth in this disclosure, regardless of whether such features or elements are expressly combined in a specific embodiment description herein. This disclosure is intended to be read holistically such that any separable features or elements of the disclosed invention, in any of its various aspects and embodiments, should be viewed as intended to be combinable unless the context clearly dictates otherwise.

BRIEF DESCRIPTION OF THE FIGURES

Figure 1:
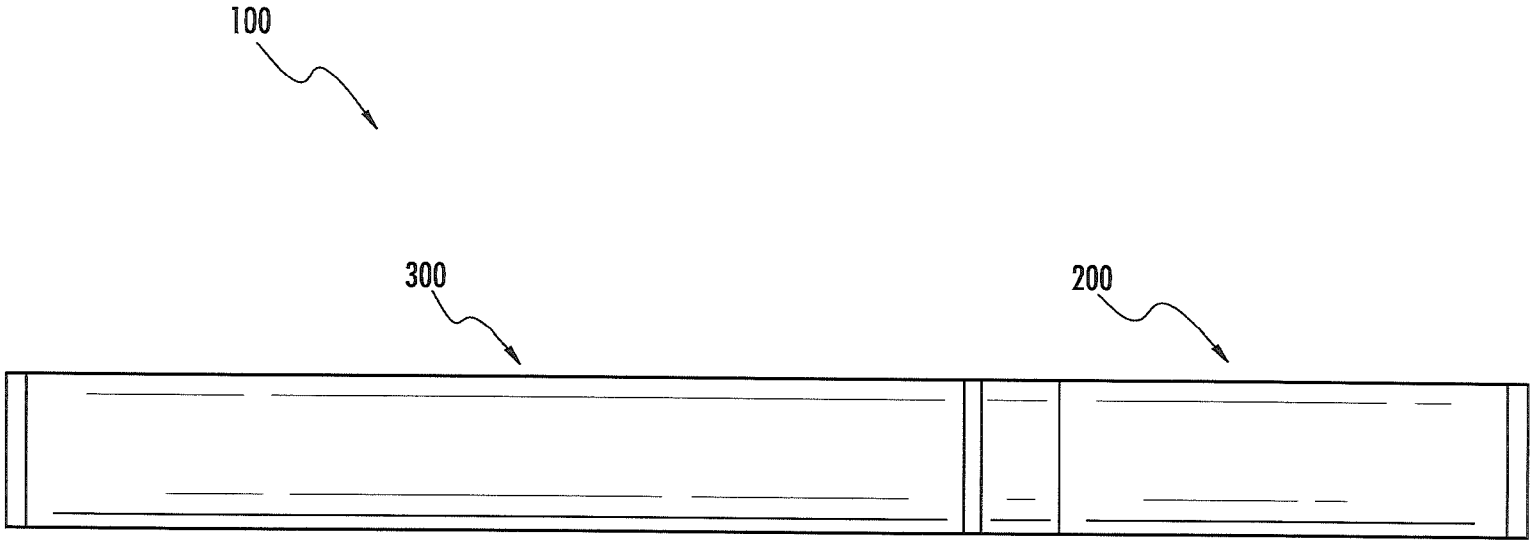
Figure 2:
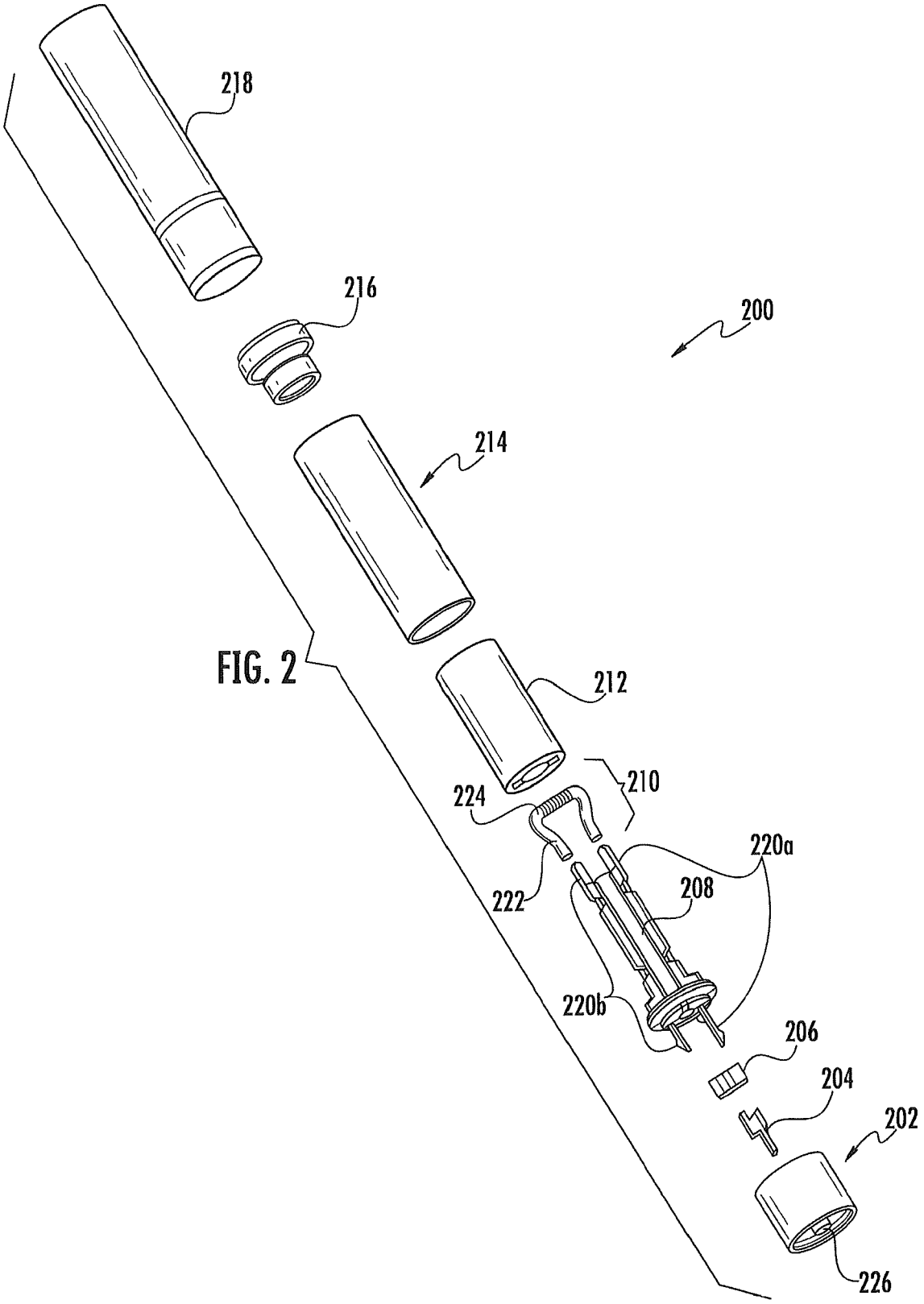
Figure 3:
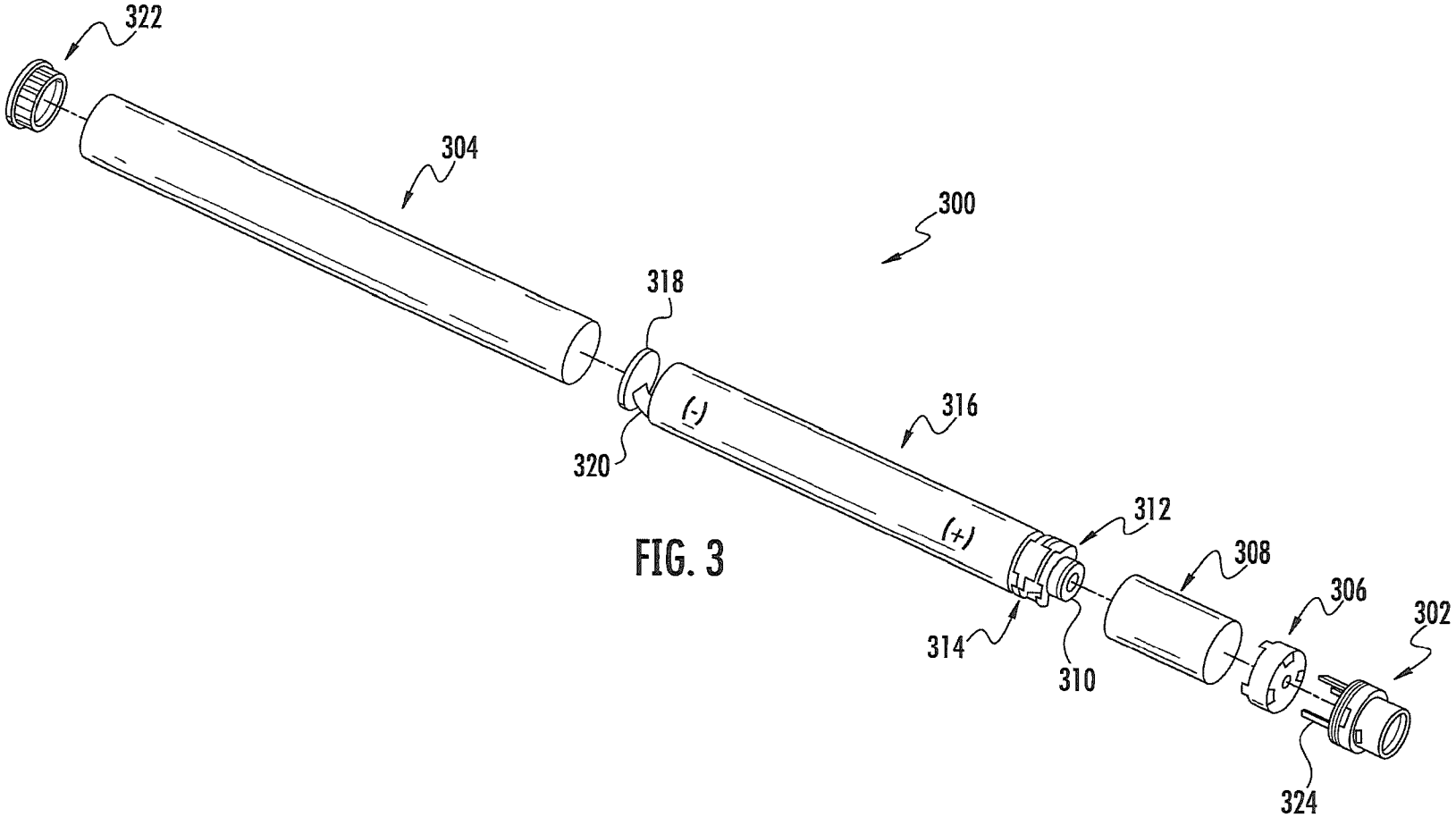
Figure 4:
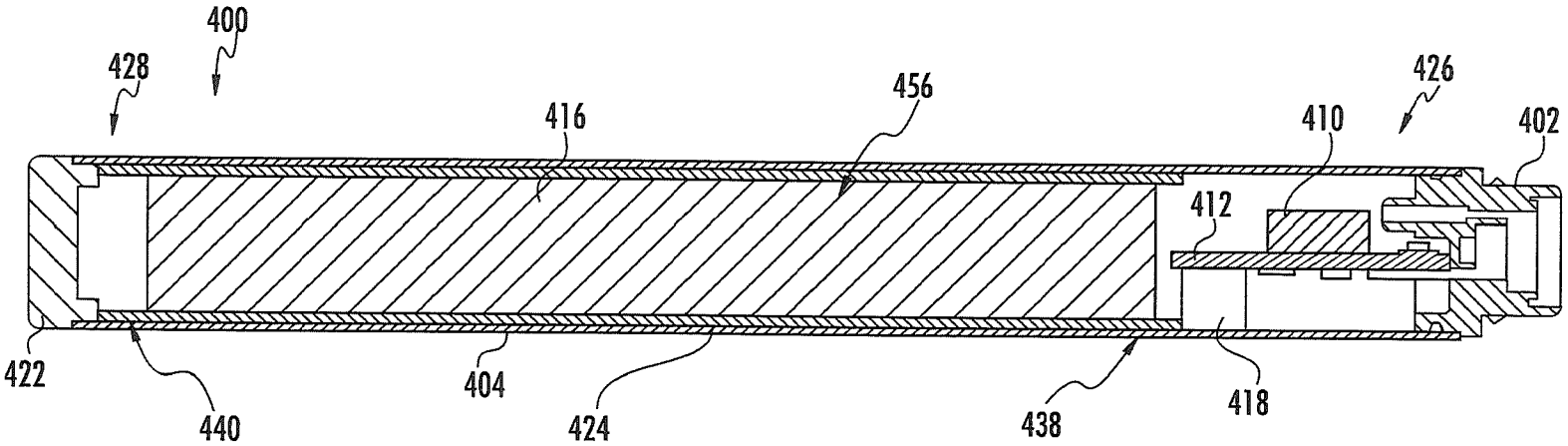
Figure 5:
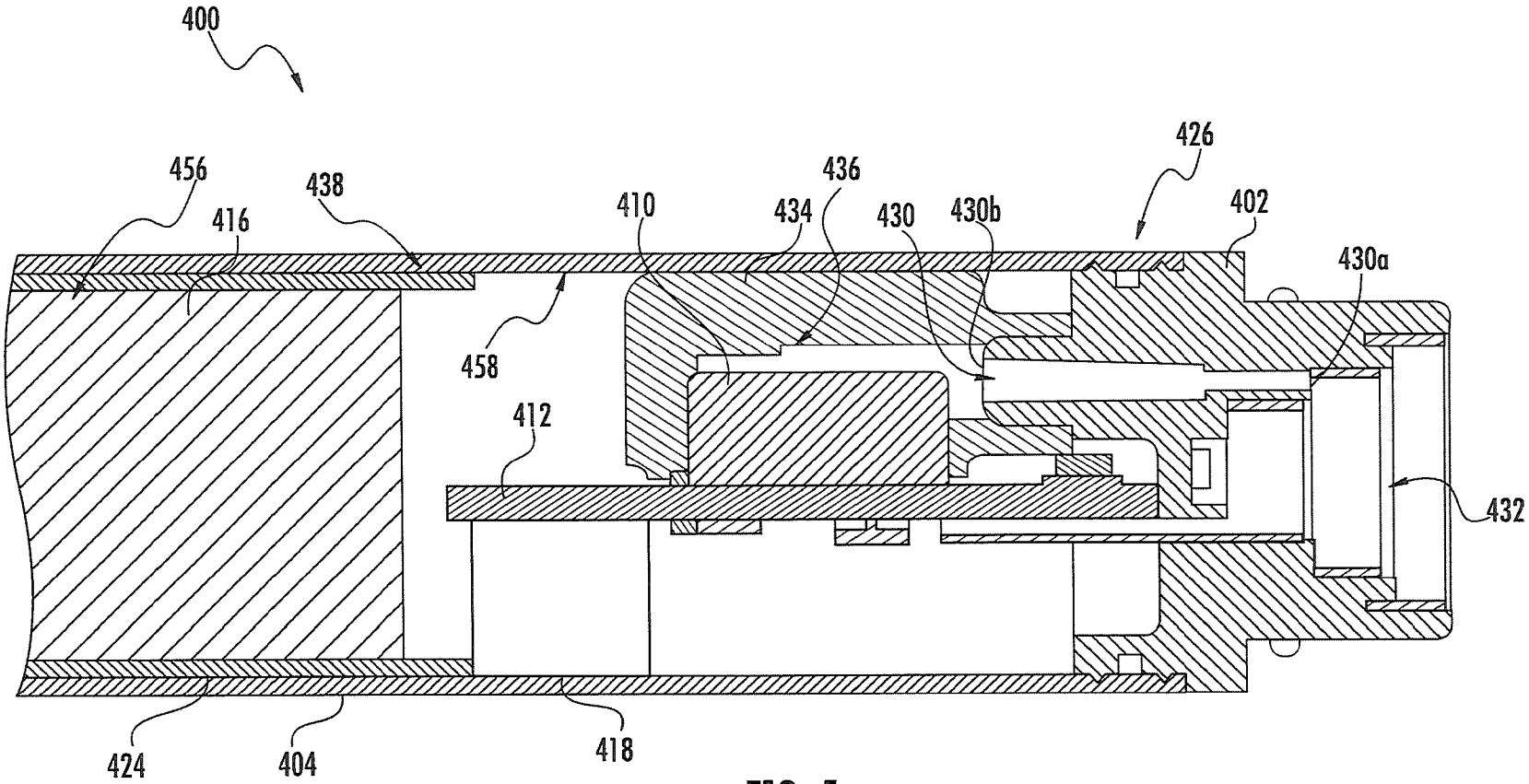
Figure 6:
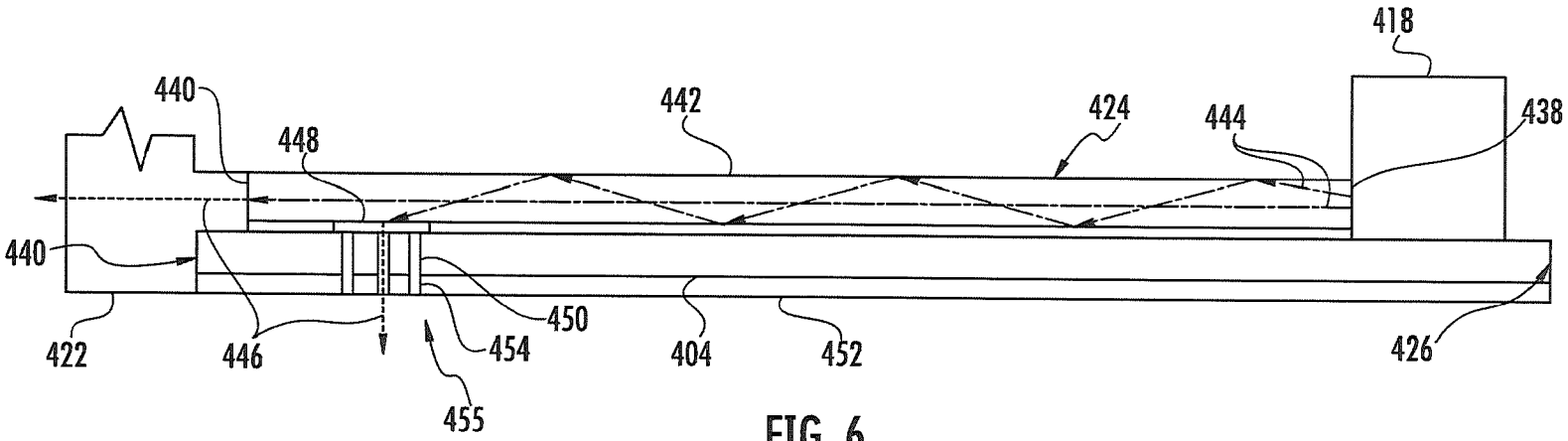
Figure 7:
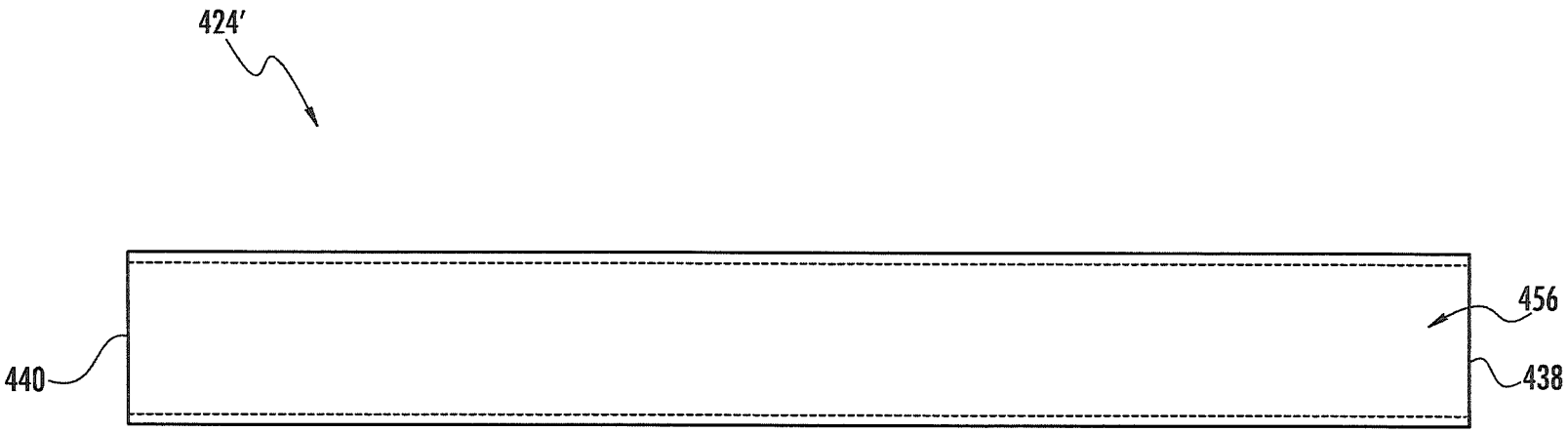
Figure 8:
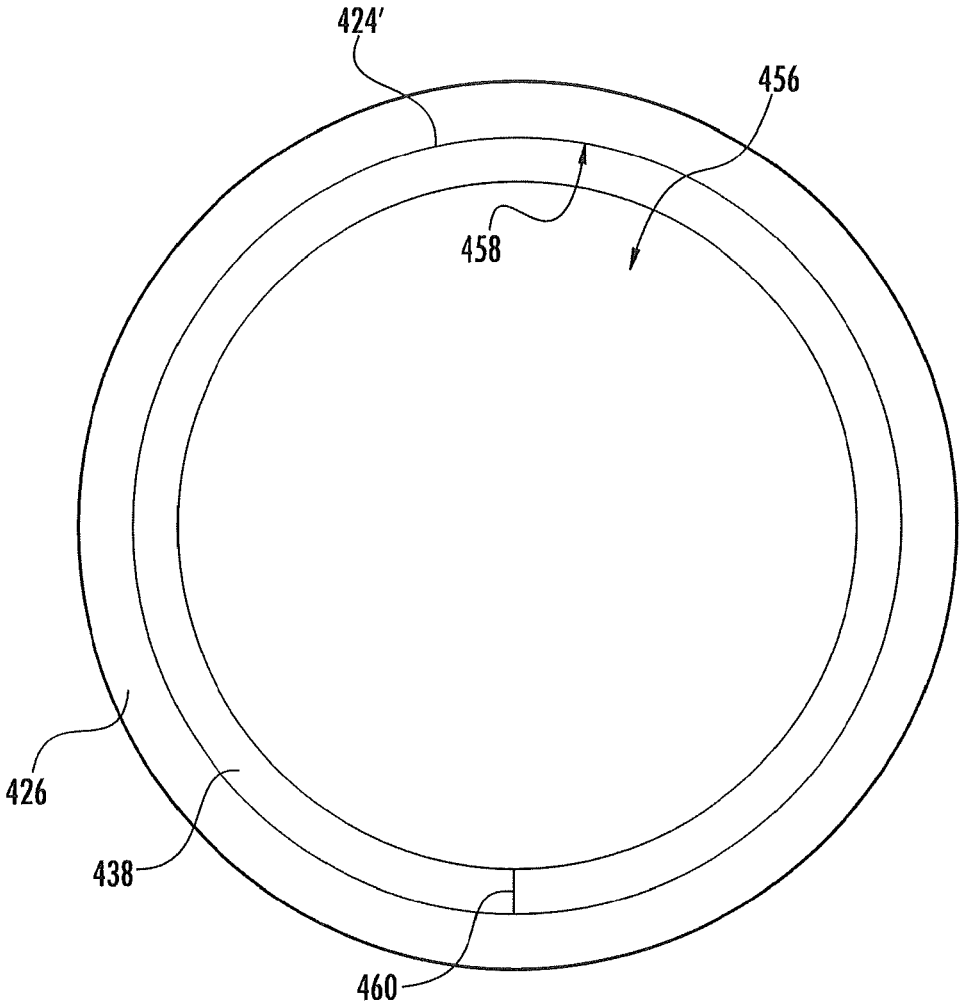
Figure 9:
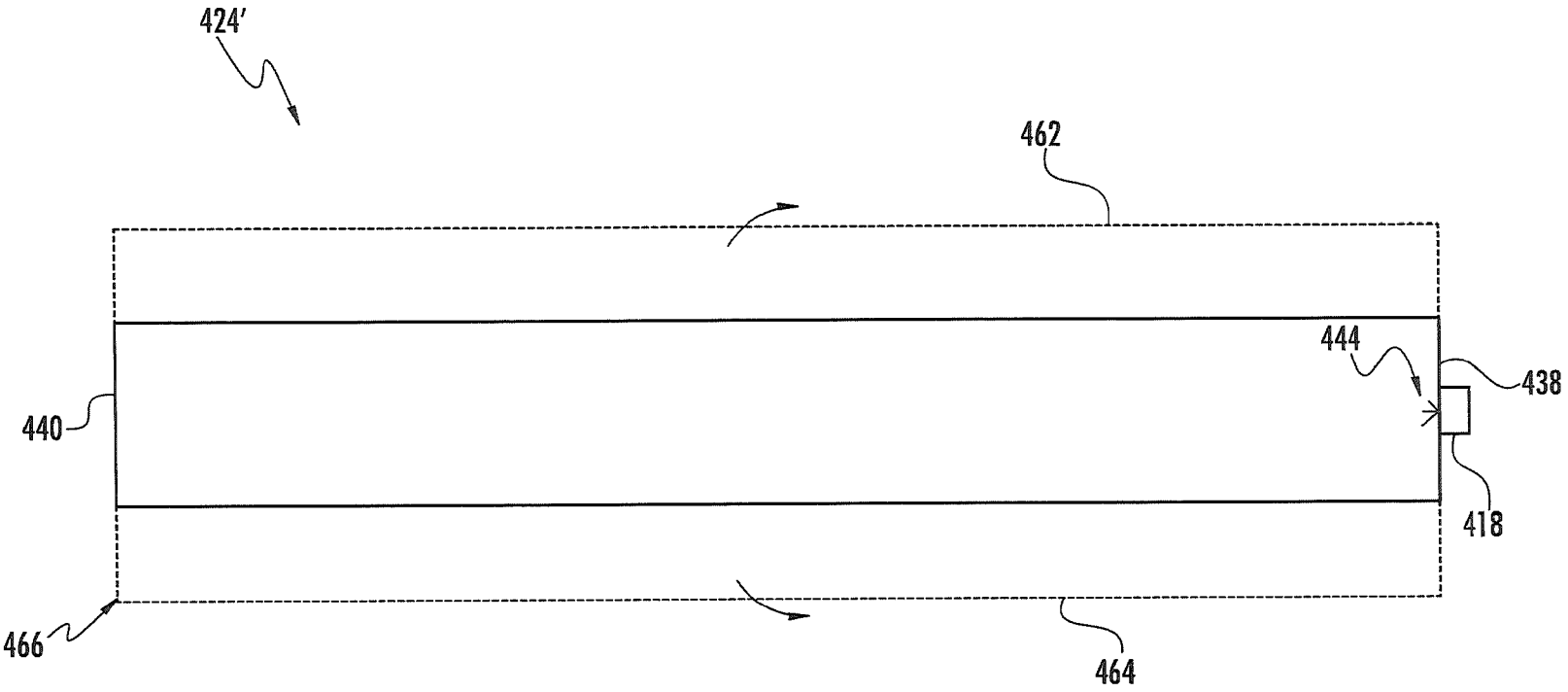
Figure 10:
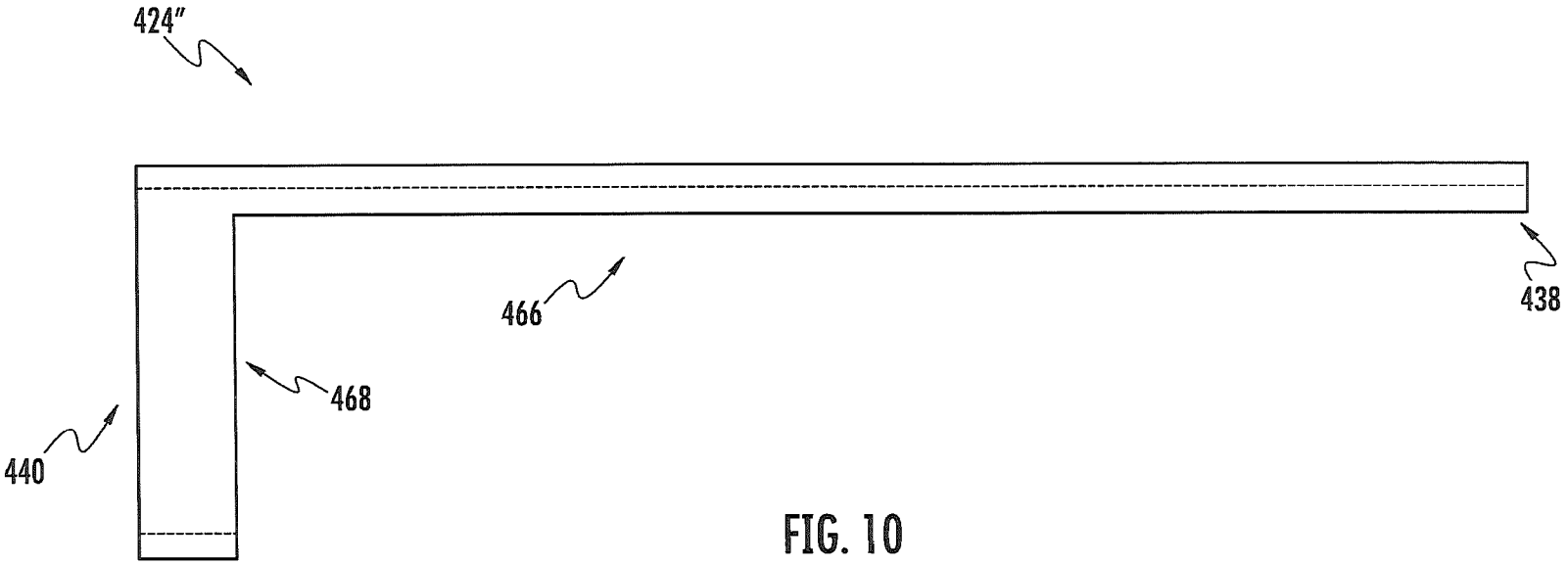
Figure 11:
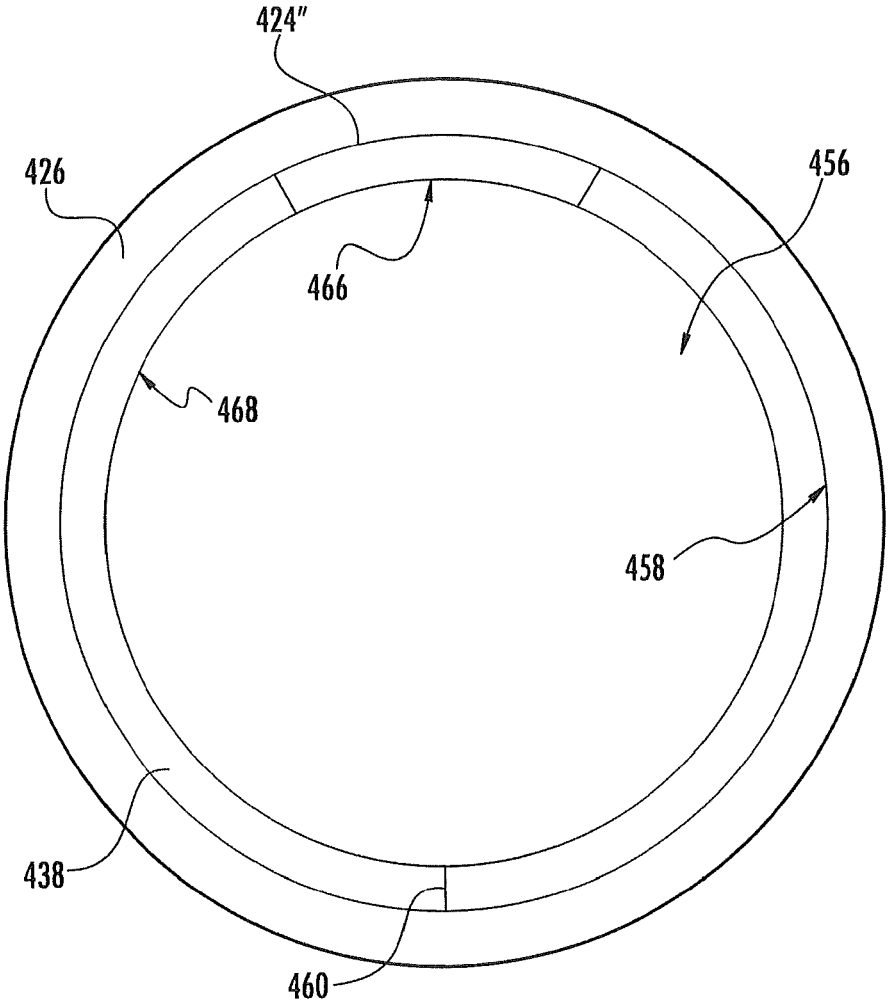
Figure 12:
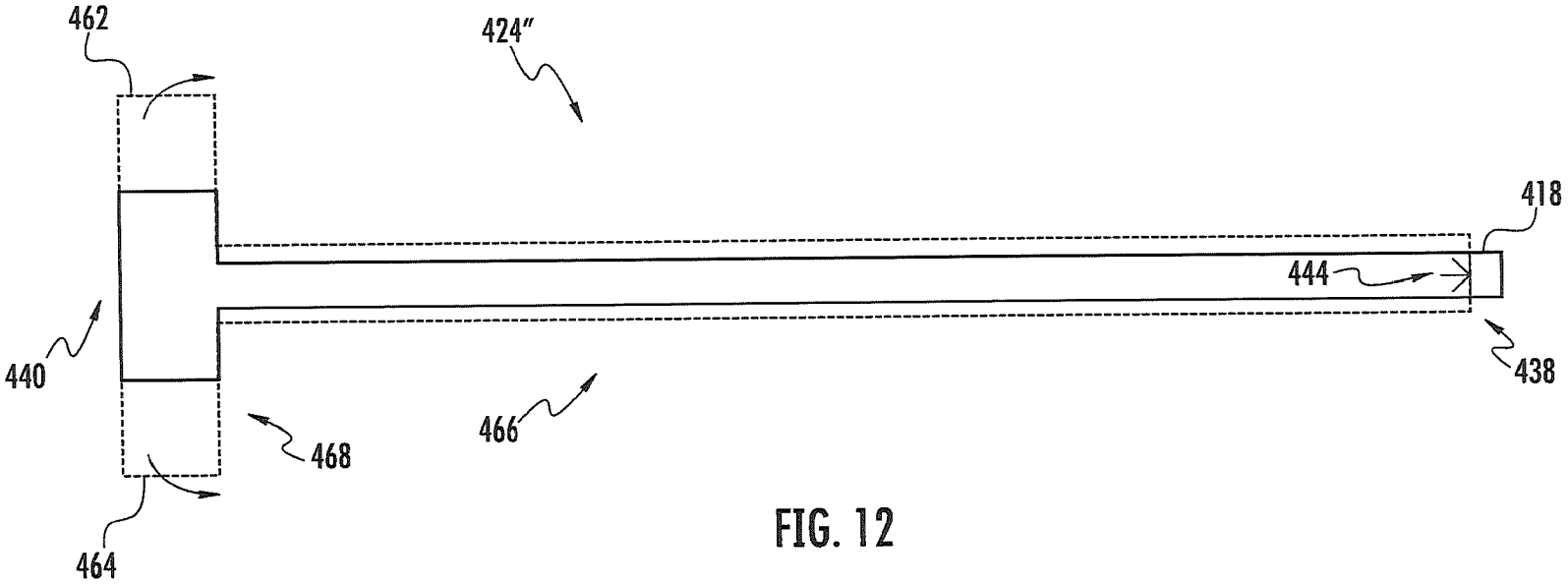
Figure 13:
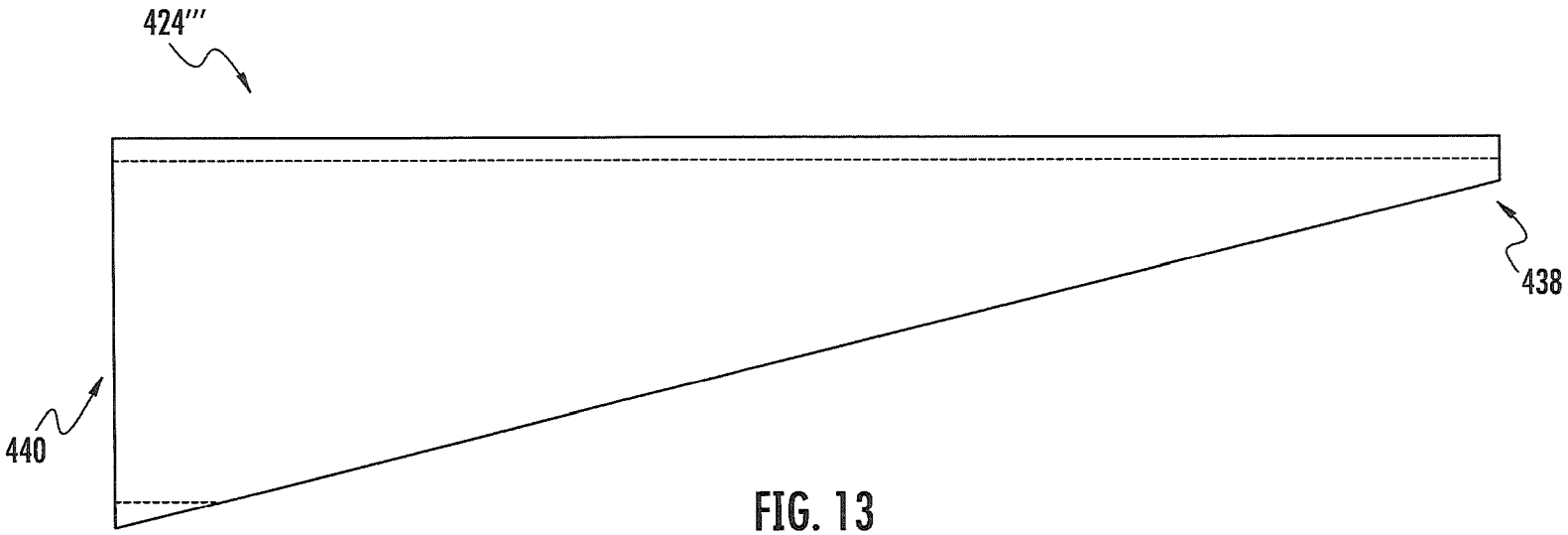
Figure 14:
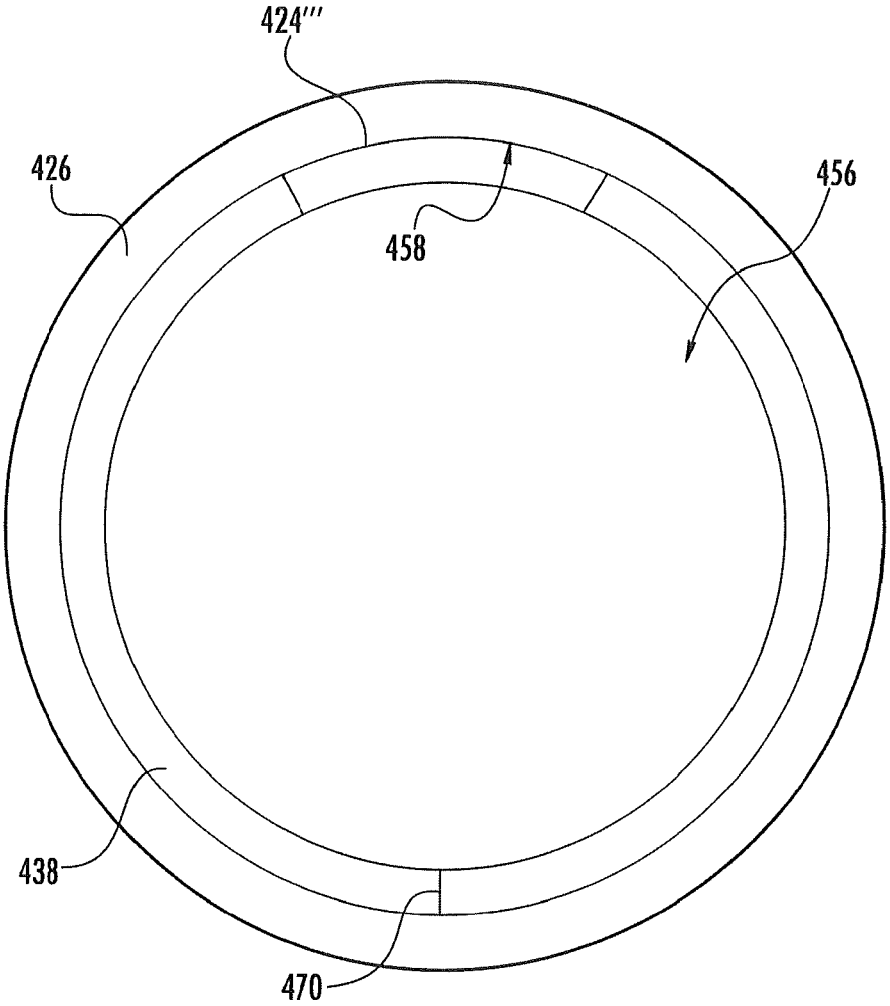
Figure 15:
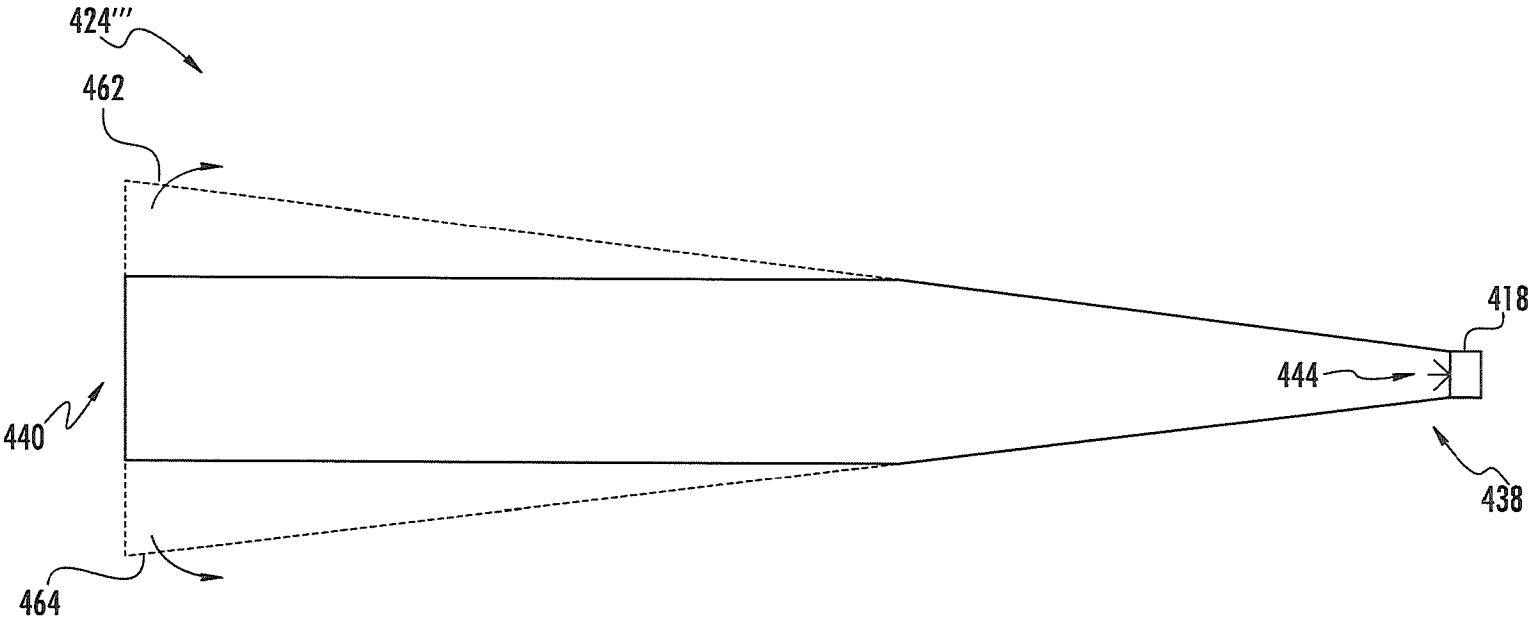
Figure 16:
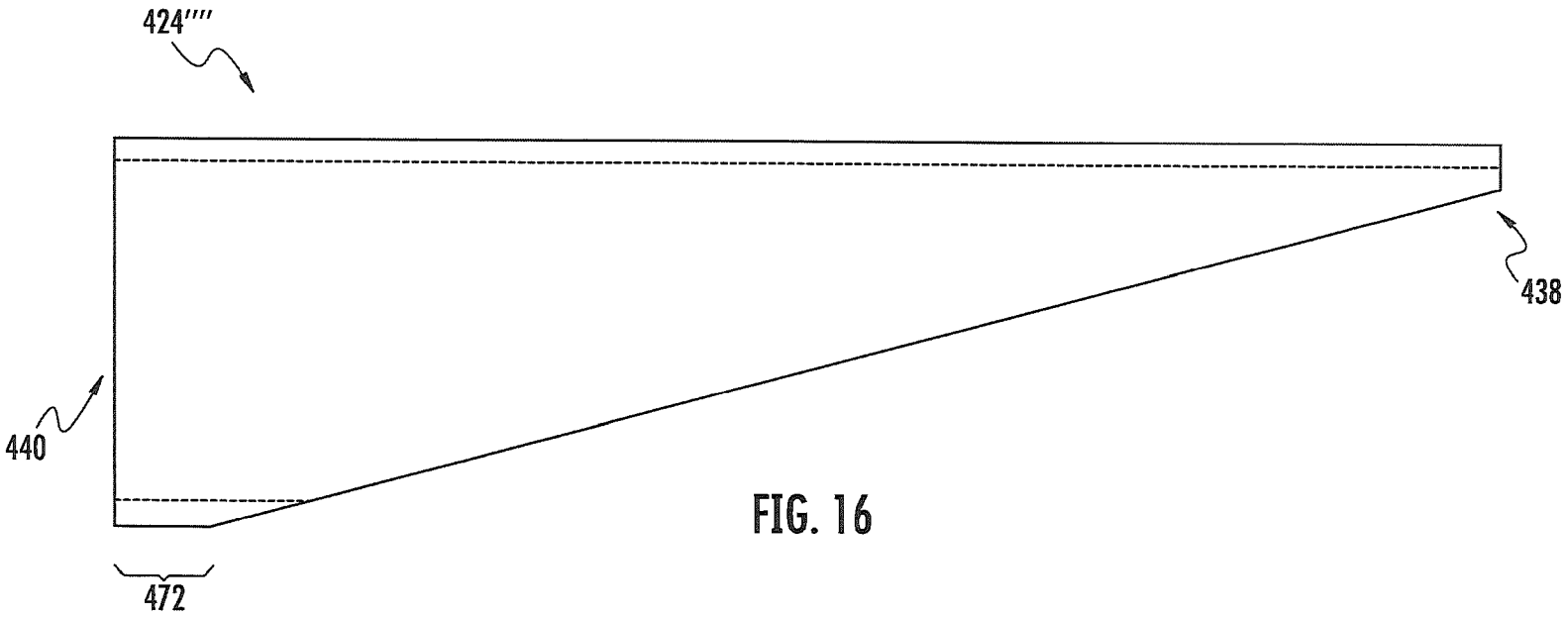
Figure 17:
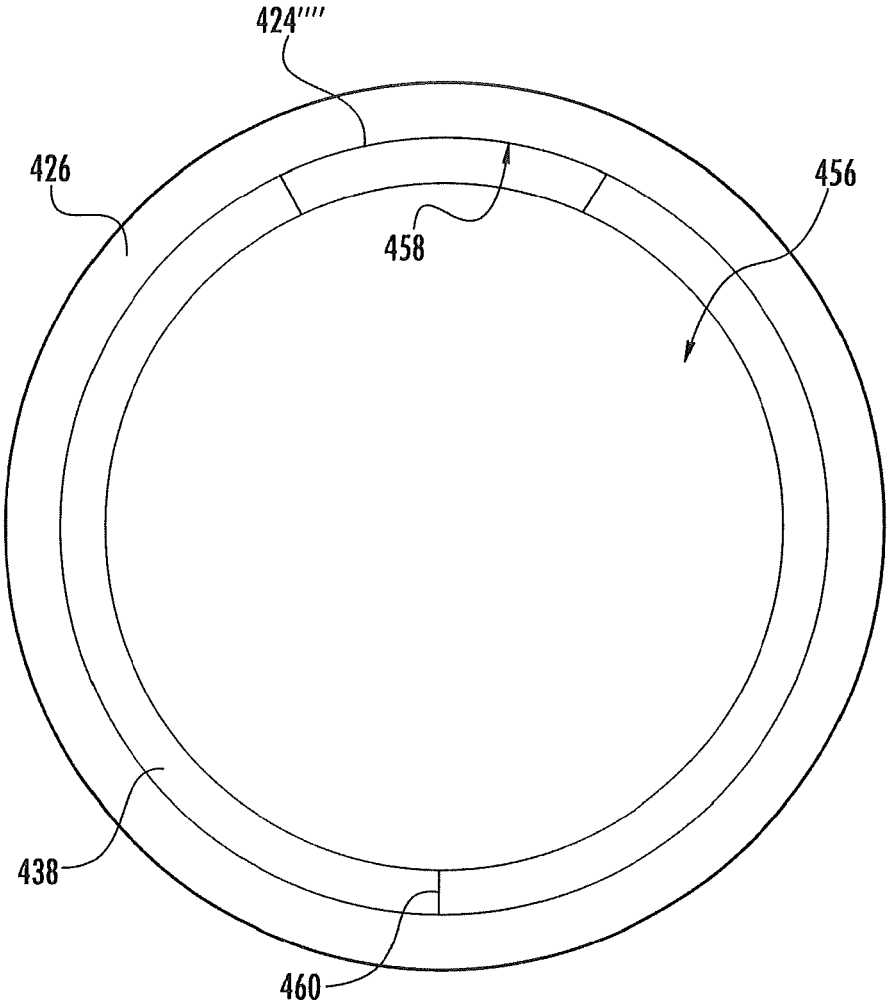
Figure 18:
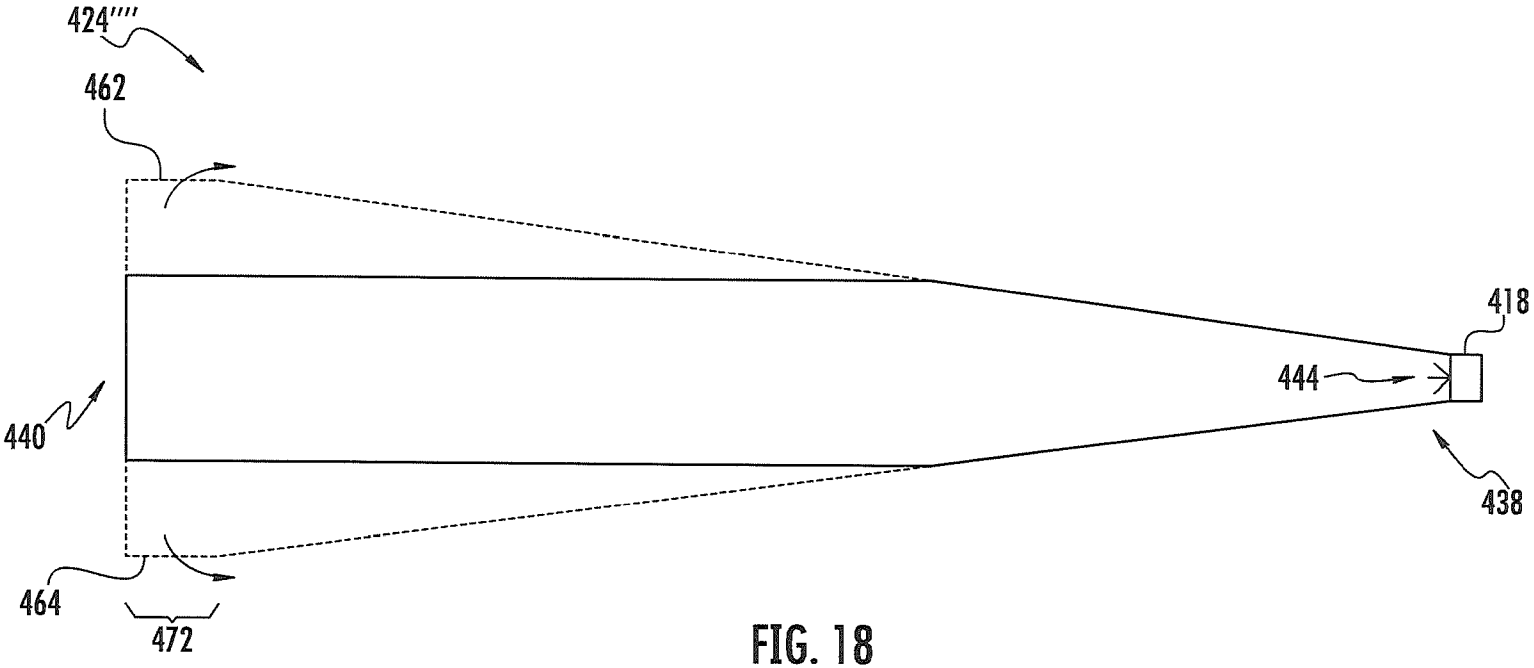
Figure 19:
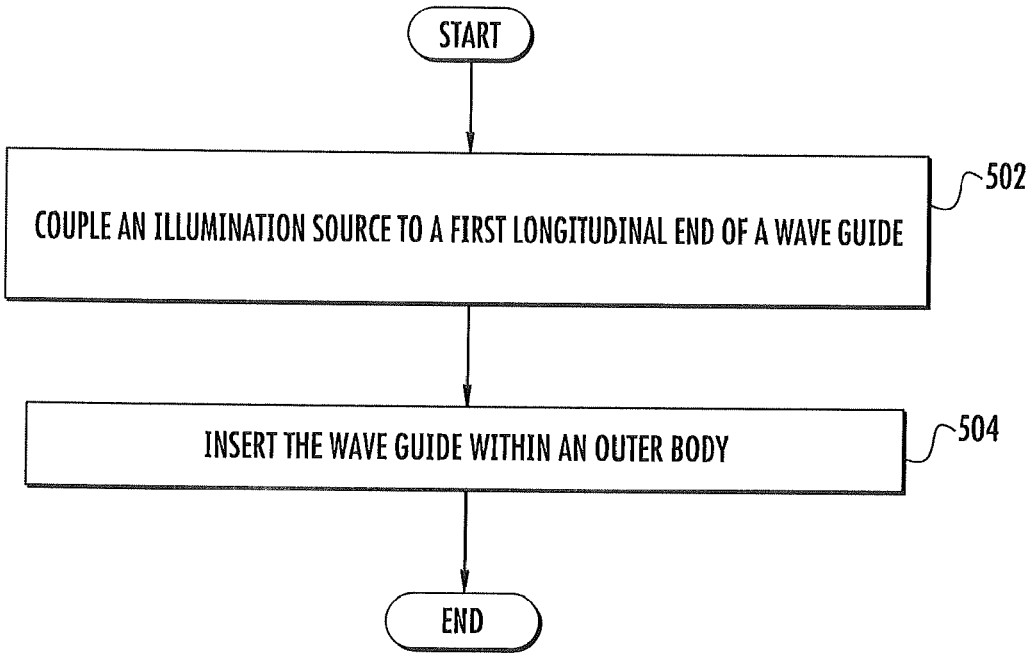

Having thus described the disclosure in the foregoing general terms, reference will now be made to the accompanying drawings, which are not necessarily drawn to scale, and wherein:

FIG. 1 illustrates a side view of an aerosol delivery device including a cartridge coupled to a control body according to an example embodiment of the present disclosure;

FIG. 2 illustrates an exploded view of the cartridge of FIG. 1 according to an example embodiment of the present disclosure;

FIG. 3 illustrates an exploded view of the control body of FIG. 1 according to an example embodiment of the present disclosure;

FIG. 4 illustrates a longitudinal sectional view through a control body including an outer body and a wave guide according to an example embodiment of the present disclosure;

FIG. 5 illustrates an enlarged, partial sectional view of the aerosol delivery device of FIG. 4;

FIG. 6 schematically illustrates emission of electromagnetic radiation into the wave guide and output of light therefrom in the control body of FIG. 4 according to an example embodiment of the present disclosure;

FIG. 7 illustrates a side view of a first embodiment of the wave guide of the control body of FIG. 4 in a bent configuration, the wave guide defining a rectangular shape prior to bending according to an example embodiment of the present disclosure;

FIG. 8 illustrates a view of a first longitudinal end of the wave guide of FIG. 7 and a first outer body end of FIG. 4, the wave guide being in the bent configuration;

FIG. 9 illustrates a top view of the wave guide of FIG. 7, the wave guide being illustrated in bent and unbent configurations;

FIG. 10 illustrates a side view of a second embodiment of the wave guide of the control body of FIG. 4 in a bent configuration, the wave guide defining a T-shape prior to bending according to an example embodiment of the present disclosure;

FIG. 11 illustrates a view of a first longitudinal end of the wave guide of FIG. 10 and a first outer body end of FIG. 4, the wave guide being in the bent configuration;

FIG. 12 illustrates a top view of the wave guide of FIG. 10, the wave guide being illustrated in bent and unbent configurations;

FIG. 13 illustrates a side view of a third embodiment of the wave guide of the control body of FIG. 4 in a bent configuration, the wave guide defining a triangular shape prior to bending, wherein one corner of the triangle is truncated according to an example embodiment of the present disclosure;

FIG. 14 illustrates a view of a first longitudinal end of the wave guide of FIG. 13 and a first outer body end of FIG. 4, the wave guide being in the bent configuration;

FIG. 15 illustrates a top view of the wave guide of FIG. 13, the wave guide being illustrated in bent and unbent configurations;

FIG. 16 illustrates a side view of a fourth embodiment of the wave guide of the control body of FIG. 4 in a bent configuration, the wave guide defining a triangular shape prior to bending, wherein three corners of the triangle are truncated according to an example embodiment of the present disclosure;

FIG. 17 illustrates a view of a first longitudinal end of the wave guide of FIG. 16 and a first outer body end of FIG. 4, the wave guide being in the bent configuration;

FIG. 18 illustrates a top view of the wave guide of FIG. 16, the wave guide being illustrated in bent and unbent configurations; and FIG. 19 schematically illustrates a method for assembling an aerosol delivery device according to an example embodiment of the present disclosure.

DETAILED DESCRIPTION OF PREFERRED EMBODIMENTS

The present disclosure will now be described more fully hereinafter with reference to exemplary embodiments thereof. These exemplary embodiments are described so that this disclosure will be thorough and complete, and will fully convey the scope of the disclosure to those skilled in the art. Indeed, the disclosure may be embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural variations unless the context clearly dictates otherwise.

The present disclosure provides descriptions of mechanisms, components, features, and methods configured to direct electromagnetic radiation through a wave guide to illuminate one or more sections of the aerosol delivery device. While the mechanisms are generally described herein in terms of embodiments associated with aerosol delivery devices such as so-called "e-cigarettes," it should be understood that the mechanisms, components, features, and methods may be embodied in many different forms and associated with a variety of articles. For example, the description provided herein may be employed in conjunction with embodiments of traditional smoking articles (e.g., cigarettes, cigars, pipes, etc.), heat-not-burn cigarettes, and related packaging for any of the products disclosed herein. Accordingly, it should be understood that the description of the mechanisms, components, features, and methods disclosed herein are discussed in terms of embodiments relating to aerosol delivery mechanisms by way of example only, and may be embodied and used in various other products and methods.

In this regard, the present disclosure provides descriptions of aerosol delivery devices that use electrical energy to heat a material (preferably without combusting the material to any significant degree) to form an inhalable substance; such articles most preferably being sufficiently compact to be considered "hand-held" devices. An aerosol delivery device may provide some or all of the sensations (e.g., inhalation and exhalation rituals, types of tastes or flavors, organoleptic effects, physical feel, use rituals, visual cues such as those provided by visible aerosol, and the like) of smoking a cigarette, cigar, or pipe, without any substantial degree of combustion of any component of that article or device. The aerosol delivery device may not produce smoke in the sense of the aerosol resulting from by-products of combustion or pyrolysis of tobacco, but rather, that the article or device most preferably yields vapors (including vapors within aerosols that can be considered to be visible aerosols that might be considered to be described as smoke-like) resulting from volatilization or vaporization of certain components of the article or device, although in other embodiments the aerosol may not be visible. In highly preferred embodiments, aerosol delivery devices may incorporate tobacco and/or components derived from tobacco. As such, the aerosol delivery device can be characterized as an electronic smoking article such as an electronic cigarette or "e-cigarette."

Aerosol delivery devices of the present disclosure also can be characterized as being vapor-producing articles or medicament delivery articles. Thus, such articles or devices can be adapted so as to provide one or more substances (e.g., flavors and/or pharmaceutical active ingredients) in an inhalable form or state. For example, inhalable substances can be substantially in the form of a vapor (i.e., a substance that is in the gas phase at a temperature lower than its critical point). Alternatively, inhalable substances can be in the form of an aerosol (i.e., a suspension of fine solid particles or liquid droplets in a gas). For purposes of simplicity, the term "aerosol" as used herein is meant to include vapors, gases and aerosols of a form or type suitable for human inhalation, whether or not visible, and whether or not of a form that might be considered to be smoke-like.

In use, aerosol delivery devices of the present disclosure may be subjected to many of the physical actions employed by an individual in using a traditional type of smoking article (e.g., a cigarette, cigar or pipe that is employed by lighting and inhaling tobacco). For example, the user of an aerosol delivery device of the present disclosure can hold that article much like a traditional type of smoking article, draw on one end of that article for inhalation of aerosol produced by that article, take puffs at selected intervals of time, etc.

Smoking articles of the present disclosure generally include a number of components provided within an outer shell or body. The overall design of the outer shell or body can vary, and the format or configuration of the outer body that can define the overall size and shape of the smoking article can vary. Typically, an elongated body resembling the shape of a cigarette or cigar can be a formed from a single, unitary shell; or the elongated body can be formed of two or more separable pieces. For example, a smoking article can comprise an elongated shell or body that can be substantially tubular in shape and, as such, resemble the shape of a conventional cigarette or cigar. In one embodiment, all of the components of the smoking article are contained within one outer body or shell. Alternatively, a smoking article can comprise two or more shells that are joined and are separable. For example, a smoking article can possess at one end a control body comprising a shell containing one or more reusable components (e.g., a rechargeable battery and various electronics for controlling the operation of that article), and at the other end and removably attached thereto a shell containing a disposable portion (e.g., a disposable flavor-containing cartridge). More specific formats, configurations and arrangements of components within the single shell type of unit or within a multi-piece separable shell type of unit will be evident in light of the further disclosure provided herein. Additionally, various smoking article designs and component arrangements can be appreciated upon consideration of the commercially available electronic smoking articles.

Aerosol delivery devices of the present disclosure most preferably comprise some combination of a power source (i.e., an electrical power source), at least one control component (e.g., means for actuating, controlling, regulating and/or ceasing power for heat generation, such as by controlling electrical current flow from the power source to other components of the aerosol delivery device), a heater or heat generation component (e.g., an electrical resistance heating element or component commonly referred to as part of an "atomizer"), and an aerosol precursor composition (e.g., commonly a liquid capable of yielding an aerosol upon application of sufficient heat, such as ingredients commonly referred to as "smoke juice," "e-liquid" and "e-juice"), and a mouthend region or tip for allowing draw upon the aerosol delivery device for aerosol inhalation (e.g., a defined air flow path through the article such that aerosol generated can be withdrawn therefrom upon draw).

Alignment of the components within the aerosol delivery device of the present disclosure can vary. In specific embodiments, the aerosol precursor composition can be located near an end of the aerosol delivery device which may be configured to be positioned proximal to the mouth of a user so as to maximize aerosol delivery to the user. Other configurations, however, are not excluded. Generally, the heating element can be positioned sufficiently near the aerosol precursor composition so that heat from the heating element can volatilize the aerosol precursor (as well as one or more flavorants, medicaments, or the like that may likewise be provided for delivery to a user) and form an aerosol for delivery to the user. When the heating element heats the aerosol precursor composition, an aerosol is formed, released, or generated in a physical form suitable for inhalation by a consumer. It should be noted that the foregoing terms are meant to be interchangeable such that reference to release, releasing, releases, or released includes form or generate, forming or generating, forms or generates, and formed or generated. Specifically, an inhalable substance is released in the form of a vapor or aerosol or mixture thereof, wherein such terms are also interchangeably used herein except where otherwise specified.

As noted above, the aerosol delivery device may incorporate a battery or other electrical power source (e.g., a capacitor) to provide current flow sufficient to provide various functionalities to the aerosol delivery device, such as powering of a heater, powering of control systems, powering of indicators, and the like. The power source can take on various embodiments. Preferably, the power source is able to deliver sufficient power to rapidly heat the heating element to provide for aerosol formation and power the aerosol delivery device through use for a desired duration of time. The power source preferably is sized to fit conveniently within the aerosol delivery device so that the aerosol delivery device can be easily handled. Additionally, a preferred power source is of a sufficiently light weight to not detract from a desirable smoking experience.

More specific formats, configurations and arrangements of components within the aerosol delivery device of the present disclosure will be evident in light of the further disclosure provided hereinafter. Additionally, the selection of various aerosol delivery device components can be appreciated upon consideration of the commercially available electronic aerosol delivery devices. Further, the arrangement of the components within the aerosol delivery device can also be appreciated upon consideration of the commercially available electronic aerosol delivery devices.

One example embodiment of an aerosol delivery device 100 is illustrated in FIG. 1. As illustrated, the aerosol delivery device 100 may include a cartridge 200 and a control body 300. In particular, FIG. 1 illustrates the cartridge 200 and the control body 300 coupled to one another. The cartridge 200 and the control body 300 can be permanently or detachably aligned in a functioning relationship. Various mechanisms may connect the cartridge 200 to the control body 300 to result in a threaded engagement, a press-fit engagement, an interference fit, a magnetic engagement, or the like. The aerosol delivery device 100 may be substantially rod-like, substantially tubular shaped, or substantially cylindrically shaped in some embodiments when the cartridge 200 and the control body 300 are in an assembled configuration.

In specific embodiments, one or both of the cartridge 200 and the control body 300 may be referred to as being disposable or as being reusable. For example, the control body 300 may have a replaceable battery or a rechargeable battery and thus may be combined with any type of recharging technology, including connection to a typical alternating current electrical outlet, connection to a car charger (i.e., a cigarette lighter receptacle), and connection to a computer, such as through a universal serial bus (USB) cable or connector. Further, in some embodiments the cartridge 200 may comprise a single-use cartridge, as disclosed in U.S. Pat. No. 8,910,639 to Chang et al., which is incorporated herein by reference in its entirety.

In one embodiment the control body 300 and the cartridge 200 may be permanently coupled to one another. Examples of aerosol delivery devices which may be configured to be disposable and/or which may include first and second outer bodies that are configured for permanent coupling are disclosed in U.S. patent application Ser. No. 14/170,838 to Bless et al., filed Feb. 3, 2014, which is incorporated herein by reference in its entirety. In another embodiment the cartridge 200 and the control body 300 forming the aerosol delivery device 100 may be configured in a single-piece, non-detachable form and may incorporate the components, aspects, and features disclosed herein. However, in another embodiment the control body 300 and the cartridge 200 may be configured to be separable such that, for example, the cartridge may be refilled or replaced.

FIG. 2 illustrates the cartridge 200 in an exploded configuration. As illustrated, the cartridge 200 may comprise a base 202, a control component terminal 204, an electronic control component 206, a flow director 208, an atomizer 210, a reservoir substrate 212, an outer body 214, a mouthpiece 216, a label 218, and first and second heating terminals 220*a*, 220*b* according to an example embodiment of the present disclosure. The atomizer 210 may comprise a liquid transport element 222 and a heating element 224. In some embodiments the cartridge may additionally include a base shipping plug engaged with the base and/or a mouthpiece shipping plug engaged with the mouthpiece in order to protect the base and the mouthpiece and prevent entry of contaminants therein prior to use as disclosed, for example, in U.S. Pat. App. Pub. No. 2014/0261408 to Depiano et al.

The base 202 may be coupled to a first outer body end 214 and the mouthpiece 216 may be coupled to an opposing second outer body end to enclose the remaining components of the cartridge 200 therein. The base 202 may be configured to engage the control body 300. In some embodiments the base 202 may comprise anti-rotation features that substantially prevent relative rotation between the cartridge and the control body as disclosed in U.S. Pat. App. Pub. No. 2014/0261495 to Novak et al., which is incorporated herein by reference in its entirety. The label 218 may at least partially surround one or more of the outer body 214, the base 202, and the mouthpiece 216, and include information such as a product identifier thereon.

Various components may be received within the outer body 214 and positioned between the base 202 and the mouthpiece 216. For example, the control component terminal 204, the electronic control component 206, the flow director 208, the atomizer 210, and the reservoir substrate 212 may be retained within the outer body 214. The atomizer 210 may comprise a first heating terminal 220*a* and a second heating terminal 220*b*, a liquid transport element 222 and a heating element 224. In this regard, the reservoir substrate 212 may be configured to hold an aerosol precursor composition, which is directed to the heating element 224 via the liquid transport element 222, as described below.

The aerosol precursor composition, also referred to as a vapor precursor composition, may comprise a variety of components including, by way of example, a polyhydric alcohol (e.g., glycerin, propylene glycol, or a mixture thereof), nicotine, tobacco, tobacco extract, and/or flavorants. Various components that may be included in the aerosol precursor composition are described in U.S. Pat. No. 7,726,320 to Robinson et al., which is incorporated herein by reference in its entirety. Additional representative types of aerosol precursor compositions are set forth in U.S. Pat. No. 4,793,365 to Sensabaugh, Jr. et al.; U.S. Pat. No. 5,101,839 to Jakob et al.; U.S. Pat. Pub. No. 2013/0008457 to Zheng et al.; PCT WO 98/57556 to Biggs et al.; and Chemical and Biological Studies on New Cigarette Prototypes that Heat Instead of Burn Tobacco, R. J. Reynolds Tobacco Company Monograph (1988); the disclosures of which are incorporated herein by reference in their entireties.

The reservoir substrate 212 may comprise a plurality of layers of nonwoven fibers formed into the shape of a tube encircling the interior of the outer body 214 of the cartridge 200. Liquid components, for example, can be sorptively retained by the reservoir substrate 212. The reservoir substrate 212 is in fluid connection with the liquid transport element 222. Thus, the liquid transport element 222 may be configured to transport liquid from the reservoir substrate 212 to the heating element 224 (e.g., via capillary action). Representative types of substrates, reservoirs or other components for supporting the aerosol precursor composition are described in U.S. Pat. No. 8,528,569 to Newton and U.S. Pat. No. 8,715,070 to Davis et al.; U.S. Pat. App. Pub. No. 2014/0261487 to Chapman et al.; and U.S. patent application Ser. No. 14/170,838 to Bless et al., filed Feb. 3, 2014; which are incorporated herein by reference in their entireties.

As illustrated, the liquid transport element 222 may be configured to be in direct contact with the heating element 224. Various wicking materials, and the configuration and operation of those wicking materials within certain types of aerosol delivery devices, are set forth in U.S. Pat. No. 8,910,640 to Sears et al., which is incorporated herein by reference in its entirety. A variety of the materials disclosed by the foregoing documents may be incorporated into the present devices in various embodiments, and all of the foregoing disclosures are incorporated herein by reference in their entireties.

The heating element 224 may comprise a wire defining a plurality of coils wound about the liquid transport element 222. In some embodiments the heating element 224 may be formed by winding the wire about the liquid transport element 222 as described in U.S. Pat. App. Pub. No. 2014/0157583 to Ward et al., which is incorporated herein by reference in its entirety. Further, in some embodiments the wire may define a variable coil spacing, as described in U.S. Pat. App. Pub. No. 2014/0270730 to DePiano et al., which is incorporated herein by reference in its entirety. Various embodiments of materials configured to produce heat when electrical current is applied therethrough may be employed to form the heating element 224. Example materials from which the wire coil may be formed include Kanthal (FeCrAl), Nichrome, Molybdenum disilicide ($MoSi_2$), molybdenum silicide (MoSi), Molybdenum disilicide doped with Aluminum ($Mo(Si,Al)_2$), graphite and graphite-based materials; and ceramic (e.g., a positive or negative temperature coefficient ceramic).

The first heating terminal **220*a* and the second heating terminal 220*b* (e.g., positive and negative terminals) at the opposing ends of the heating element 224 are configured to form an electrical connection with the control body 300 when the cartridge 200 is connected thereto. Further, when the control body 300 is coupled to the cartridge 200, the electronic control component 206 may form an electrical connection with the control body through the control component terminal 204. The control body 300 may thus employ the electronic control component 206 to determine whether the cartridge 200** is genuine and/or perform other functions. Further, various examples of electronic control components and functions performed thereby are described in U.S. Pat. App. Pub. No. 2014/0096781 to Sears et al., which is incorporated herein by reference in its entirety.

Various other details with respect to the cartridge 200 are described above are provided in U.S. patent application Ser. No. 14/286,552 to Brinkley et al., filed May 23, 2014. Further, it should be understood that the cartridge 200 may be assembled in a variety of manners and may include additional or fewer components which may be the same or different in other embodiments. For example, although the cartridge 200 is generally described herein as including a reservoir substrate, in other embodiments the cartridge may hold an aerosol precursor composition therein without the use of a reservoir substrate (e.g., through use of a container or vessel that stores the aerosol precursor composition or direct storage therein). In some embodiments, an aerosol precursor composition may be within a container or vessel that may also include a porous (e.g., fibrous) material therein. Further, in other embodiments the aerosol precursor composition may be delivered to the atomizer via other mechanisms such as positive displacement mechanisms as disclosed in U.S. patent application Ser. No. 14/309,282, filed Jun. 19, 2014, bubble jet heads as disclosed in U.S. patent application Ser. No. 14/524,778, filed Oct. 29, 2014, and pressurized dispensers as disclosed in U.S. patent application Ser. No. 14/289,101, filed May 28, 2014, each to Brammer et al., each of which is incorporated herein by reference in its entirety. Additionally, although usage of a coil heating element is generally discussed herein, in other embodiments the atomizer may comprise a microheater, one or more vaporization heating elements, and/or various atomizers as disclosed, for example, in U.S. patent application Ser. No. 14/309,282, filed Jun. 19, 2014; U.S. patent application Ser. No. 14/524,778, filed Oct. 29, 2014; and U.S. patent application Ser. No. 14/289,101, filed May 28, 2014, each to Brammer et al. and U.S. Pat. No. 8,881,737 to Collett et al., each of which is incorporated herein by reference in its entirety.

Various other details with respect to the components that may be included in the cartridge, are provided, for example, in U.S. Pat. App. Pub. No. 2014/0261495 to Novak et al., which is incorporated herein by reference in its entirety. In this regard, FIG. 7 thereof illustrates an enlarged exploded view of a base and a control component terminal; FIG. 8 thereof illustrates an enlarged perspective view of the base and the control component terminal in an assembled configuration; FIG. 9 thereof illustrates an enlarged perspective view of the base, the control component terminal, an electronic control component, and heater terminals of an atomizer in an assembled configuration; FIG. 10 thereof illustrates an enlarged perspective view of the base, the atomizer, and the control component in an assembled configuration; FIG. 11 thereof illustrates an opposing perspective view of the assembly of FIG. 10 thereof; FIG. 12 thereof illustrates an enlarged perspective view of the base, the atomizer, the flow tube, and the reservoir substrate in an assembled configuration; FIG. 13 thereof illustrates a perspective view of the base and an outer body in an assembled configuration; FIG. 14 thereof illustrates a perspective view of a cartridge in an assembled configuration; FIG. 15 thereof illustrates a first partial perspective view of the cartridge of FIG. 14 thereof and a coupler for a control body; FIG. 16 thereof illustrates an opposing second partial perspective view of the cartridge of FIG. 14 thereof and the coupler of FIG. 11 thereof; FIG. 17 thereof illustrates a perspective view of a cartridge including a base with an anti-rotation mechanism; FIG. 18 thereof illustrates a perspective view of a control body including a coupler with an anti-rotation mechanism; FIG. 19 thereof illustrates alignment of the cartridge of FIG. 17 with the control body of FIG. 18; FIG. 20 thereof illustrates an aerosol delivery device comprising the cartridge of FIG. 17 thereof and the control body of FIG. 18 thereof with a modified view through the aerosol delivery device illustrating the engagement of the anti-rotation mechanism of the cartridge with the anti-rotation mechanism of the connector body; FIG. 21 thereof illustrates a perspective view of a base with an anti-rotation mechanism; FIG. 22 thereof illustrates a perspective view of a coupler with an anti-rotation mechanism; and FIG. 23 thereof illustrates a sectional view through the base of FIG. 21 thereof and the coupler of FIG. 22 thereof in an engaged configuration.

Various components of an aerosol delivery device according to the present disclosure can be chosen from components described in the art and commercially available. Reference is made for example to the reservoir and heater system for controllable delivery of multiple aerosolizable materials in an electronic smoking article disclosed in U.S. Pat. App. Pub. No. 2014/0000638 to Sebastian et al., which is incorporated herein by reference in its entirety.

Note further that portions of the cartridge 200 illustrated in FIG. 2 are optional. In this regard, by way of example, the cartridge 200 may not include the flow director 208, the control component terminal 204, and/or the electronic control component 206 in some embodiments.

In another embodiment substantially the entirety of the cartridge may be formed from one or more carbon materials, which may provide advantages in terms of biodegradability and absence of wires. In this regard, the heating element may comprise carbon foam, the reservoir may comprise carbonized fabric, and graphite may be employed to form an electrical connection with the battery and controller. An example embodiment of a carbon-based cartridge is provided in U.S. Pat. App. Pub. No. 2013/0255702 to Griffith et al., which is incorporated herein by reference in its entirety.

FIG. 3 illustrates an exploded view of the control body 300 of the aerosol delivery device 100 according to an example embodiment of the present disclosure. As illustrated, the control body 300 may comprise a coupler 302, an outer body 304, a sealing member 306, an adhesive member 308 (e.g., KAPTON® tape), a flow sensor 310 (e.g., a puff sensor or a pressure switch or sensor configured to detect a pressure drop or flow of air), a control component 312, a spacer 314, an electrical power source 316 (e.g., a battery, which may be rechargeable), a circuit board with an indicator 318 (e.g., a light emitting diode (LED)), a connector circuit 320, and an end cap 322. Examples of electrical power sources are described in U.S. Pat. App. Pub. No. 2010/0028766 to Peckerar et al., the disclosure of which is incorporated herein by reference in its entirety.

The aerosol delivery device 100 most preferably incorporates a sensor or detector for control of supply of electric power to a heat generation element when aerosol generation is desired (e.g., upon draw during use). As such, for example, there is provided a manner or method for turning off the power supply to the heat generation element when the aerosol generating piece is not being drawn upon during use, and for turning on the power supply to actuate or trigger the generation of heat by the heat generation element during draw.

For example, with respect to the flow sensor 310, representative current regulating components and other current controlling components including various microcontrollers, sensors, and switches for aerosol delivery devices are described in U.S. Pat. No. 4,735,217 to Gerth et al.; U.S. Pat. No. 4,947,874 to Brooks et al.; U.S. Pat. No. 5,372,148 to McCafferty et al.; U.S. Pat. No. 6,040,560 to Fleischhauer et al.; U.S. Pat. No. 7,040,314 to Nguyen et al. U.S. Pat. No. 8,205,622 to Pan, and U.S. Pat. No. 8,881,737 to Collet et al.; U.S. Pat. Pub. Nos. 2009/0230117 to Fernando et al. and 2014/0270727 to Ampolini et al.; and U.S. patent application Ser. No. 14/209,191, filed Mar. 13, 2014, to Henry et al.; which are incorporated herein by reference in their entireties. Additional representative types of sensing or detection mechanisms, structures, components, configurations, and general methods of operation thereof, are described in U.S. Pat. No. 5,261,424 to Sprinkel, Jr.; U.S. Pat. No. 5,372,148 to McCafferty et al.; and PCT WO 2010/003480 to Flick; which are incorporated herein by reference in their entireties.

In one embodiment the indicator 318 may comprise one or more light emitting diodes. The indicator 318 can be in communication with the control component 312 through the connector circuit 320 and illuminate, for example, during a user drawing on a cartridge (e.g., the cartridge 200) coupled to the coupler 302, as detected by the flow sensor 310. The end cap 322 may be adapted to make visible the illumination provided thereunder by the indicator 318. Accordingly, the indicator 318 may illuminate during use of the aerosol delivery device 100 to simulate the lit end of a smoking article. However, in other embodiments the indicator 318 can be provided in varying numbers and can take on different shapes and can even be an opening in the outer body (such as for release of sound when such indicators are present).

Various elements that may be included in the control body are described in U.S. application Ser. No. 14/193,961 to Worm et al., filed Feb. 28, 2014, which is incorporated herein by reference in its entirety. Still further components can be utilized in the aerosol delivery device of the present disclosure. For example, U.S. Pat. No. 5,154,192 to Sprinkel et al. discloses indicators for smoking articles; U.S. Pat. No. 5,261,424 to Sprinkel, Jr. discloses piezoelectric sensors that can be associated with the mouth-end of a device to detect user lip activity associated with taking a draw and then trigger heating; U.S. Pat. No. 5,372,148 to McCafferty et al. discloses a puff sensor for controlling energy flow into a heating load array in response to a pressure drop through a mouthpiece; U.S. Pat. No. 5,967,148 to Harris et al. discloses receptacles in a smoking device that include an identifier that detects a non-uniformity in infrared transmissivity of an inserted component and a controller that executes a detection routine as the component is inserted into the receptacle; U.S. Pat. No. 6,040,560 to Fleischhauer et al. describes a defined executable power cycle with multiple differential phases; U.S. Pat. No. 5,934,289 to Watkins et al. discloses photonic-optronic components; U.S. Pat. No. 5,954,979 to Counts et al. discloses means for altering draw resistance through a smoking device; U.S. Pat. No. 6,803,545 to Blake et al. discloses specific battery configurations for use in smoking devices; U.S. Pat. No. 7,293,565 to Griffen et al. discloses various charging systems for use with smoking devices; U.S. Pat. No. 8,402,976 to Fernando et al. discloses computer interfacing means for smoking devices to facilitate charging and allow computer control of the device; U.S. Pat. No. 8,689,804 to Fernando et al. discloses identification systems for smoking devices; and WO 2010/003480 to Flick discloses a fluid flow sensing system indicative of a puff in an aerosol generating system; all of the foregoing disclosures being incorporated herein by reference in their entireties. Further examples of components related to electronic aerosol delivery articles and disclosing materials or components that may be used in the present article include U.S. Pat. No. 4,735,217 to Gerth et al.; U.S. Pat. No. 5,249,586 to Morgan et al.; U.S. Pat. No. 5,666,977 to Higgins et al.; U.S. Pat. No. 6,053,176 to Adams et al.; U.S. Pat. No. 6,164,287 to White; U.S. Pat. No. 6,196,218 to Voges; U.S. Pat. No. 6,810,883 to Felter et al.; U.S. Pat. No. 6,854,461 to Nichols; U.S. Pat. No.

7,832,410 to Hon; U.S. Pat. No. 7,513,253 to Kobayashi; U.S. Pat. No. 7,896,006 to Hamano; U.S. Pat. No. 6,772,756 to Shayan; U.S. Pat. Nos. 8,156,944 and 8,375,957 to Hon; U.S. Pat. No. 8,794,231 to Thorens et al.; U.S. Pat. No. 8,851,083 to Oglesby et al.; U.S. Pat. Nos. 8,915,254 and 8,925,555 to Monsees et al.; U.S. Pat. App. Pub. Nos. 2006/0196518 and 2009/0188490 to Hon; U.S. Pat. App. Pub. No. 2010/0024834 to Oglesby et al.; U.S. Pat. App. Pub. No. 2010/0307518 to Wang; U.S. Pat. App. Pub. No. 2014/0261408 to DePiano et al.; WO 2010/091593 to Hon; and WO 2013/089551 to Foo, each of which is incorporated herein by reference in its entirety.

During use, a user may draw on the mouthpiece 216 of the cartridge 200 of the aerosol delivery device 100. This may pull air through an opening in the control body 300 or in the cartridge 200. For example, in one embodiment an opening may be defined between the coupler 302 and the outer body 304 of the control body 300, as described in U.S. Pat. App. Pub. No. 2014/0261408 to DePiano et al., which is incorporated herein by reference in its entirety. However, the flow of air may be received through other parts of the aerosol delivery device 100 in other embodiments. As noted above, in some embodiments the cartridge 200 may include the flow director 208. The flow director 208 may be configured to direct the flow of air received from the control body 300 to the heating element 224 of the atomizer 210.

A sensor in the aerosol delivery device 100 (e.g., the flow sensor 310 in the control body 300) may sense the puff. When the puff is sensed, the control body 300 may direct current to the heating element 224 through a circuit including the first heating terminal 220*a* and the second heating terminal 220*b*. Accordingly, the heating element 224 may vaporize the aerosol precursor composition directed to an aerosolization zone from the reservoir substrate 212 by the liquid transport element 222. Thus, the mouthpiece 216 may allow passage of air and entrained vapor (i.e., the components of the aerosol precursor composition in an inhalable form) from the cartridge 200 to a consumer drawing thereon.

As noted above, in some embodiments the control body 300 may include the indicator 318 (e.g., an LED), which may be configured to illuminate an end of the control body. For example, the indicator 318 may illuminate the end cap 322 during use of the aerosol delivery device 100 to simulate the lit end of a smoking article. However, it may be desirable to illuminate other or additional portions of an aerosol delivery device. Further, it may be desirable to transmit light within the aerosol delivery device to one or more locations positioned distally from the light source such that the position of the light source may be selected to facilitate assembly of the control body and/or provide other advantages.

In this regard, as discussed below, embodiments of the present disclosure provide aerosol delivery devices including a wave guide, which may also be referred to as a light guide in embodiments in which the wave guide receives light in the visible spectrum. Embodiments of smoking devices including light guides are disclosed, for example, in U.S. Pat. No. 8,539,959 to Scatterday and U.S. Pat. No. 8,757,147 to Terry et al.; U.S. Pat. App. Pub. No. 2014/0246018 to Terry et al.; and PCT Pat. App. Pub. No. 2014/040217 to Liu, which are incorporated herein by reference in their entireties. However, various advances with respect to the shape, configuration, and other properties of the wave guide may be desirable.

In this regard, FIG. 4 illustrates a cross-sectional view through a control body 400 according to an additional example embodiment of the present disclosure. The control body 400 may be configured to engage the above-described cartridge 200 and/or various other embodiments of cartridges. Accordingly, the control body 400 may be configured to direct current to the cartridge 200 in substantially the same manner as described above with respect to the control body 200 illustrated in FIGS. 1 and 3 to produce an aerosol during use.

As illustrated, the control body 400 may include a coupler 402, a shell or outer body 404, a flow sensor 410, a control component 412 (e.g., an electronic circuit board), an electrical power source 416 (e.g., a battery, which may be rechargeable), an illumination source 418 (e.g., a light emitting diode), an end cap 422, and a wave guide 424. The coupler 402 may be coupled to a first outer body end 426 of the outer body 404 and the end cap 422 may be coupled to a second outer body end 428 of the outer body, opposite from the first outer body end. Thereby, the flow sensor 410, the control component 412, the electrical power source 416, the illumination source 418, and the wave guide 424 may be substantially enclosed within the outer body 404 and between the end cap 422 and the coupler 402.

FIG. 5 illustrates an enlarged cross-sectional view through the control body 400 at the first outer body end 426 of the outer body 404. As illustrated, the flow sensor 410 may be coupled to the control component 412 in some embodiments. Thereby, the control component 412 may receive a signal from the flow sensor 410 (e.g., indicating when a user draw is detected), and direct current to the atomizer 210 in the cartridge 200 (see, e.g., FIG. 2) to produce an aerosol. In this regard, a pressure channel 430 may be defined through the coupler 402. A first end 430*a* of the pressure channel 430 may be in communication with a cavity 432 defined by the coupler 402. The cavity 432 may be sized and shaped to receive a projection 226 defined by the base 202 of the cartridge 202 (see FIG. 2). Further, the pressure channel 430 may define a second end 430*b* positioned inside the outer body 404. Thereby, the flow sensor 410 may be in fluid communication with the cartridge 200 through the pressure channel 430 such that the flow sensor may detect a draw on the cartridge.

As illustrated in FIG. 5, the control body 400 may optionally include a sealing member 434. The sealing member 434 may be configured to form an air tight seal around the pressure sensor 410 and the second end 430*b* of the pressure channel 430. As such, a pressure detection space 436 may be defined within the sealing member 434 and in fluid communication with the flow sensor 410 and the second end 430*b* of the pressure channel 430. The pressure detection space 436 may allow for more precise detection of a draw on the cartridge 200 by reducing a volume of air which the flow sensor 410 is in fluid communication with. Thereby, the pressure drop to which the flow sensor 410 is exposed may be amplified in comparison to embodiments in which the flow sensor 410 is exposed to a larger volume of air. Additional details with regard to the coupler and the general configuration of the control body are provided in U.S. patent application Ser. No. 14/193,961, filed Feb. 28, 2014, to Worm et al., which is incorporated herein by reference in its entirety.

When a draw is detected by the flow sensor 410, and/or at other times, the control component 412 may direct current to the illumination source 418 to output light from the control body 400. In this regard, the illumination source 418 and the wave guide 424 may be configured to cooperate to illuminate the control body 400. In particular, as described in detail below, the illumination source 418 may output electromagnetic radiation into the wave guide 424, and the wave guide may output light to thereby illuminate the control body 400. For example, such illumination may be configured to output information to a user and/or display graphics or icons.

As illustrated, the illumination source 418 may be positioned proximate the coupler 402. In this regard, the illumination source 418 may be coupled to the control component 412. Positioning the illumination source 418 (and/or various other components such as the flow sensor 410) in engagement with the wave guide 424 may facilitate assembly of the control body 400 by allowing for insertion of the control component and the illumination source (and/or various other components) within the outer body 404 in a single step, from a single end of the outer body. Thus, although the embodiment of the control body 300 illustrated in FIG. 3 provides for illumination the end cap 322 via placement of the indicator 318 in close proximity thereto, such a configuration may require more complex assembly steps and/or usage of the connector circuit 320, which may thus result in a relatively long and/or fragile circuit that requires careful insertion within the outer body 304 to facilitate the proper insertion and placement thereof. Accordingly, the control body 400 of FIG. 4 provides an alternative configuration for outputting illumination.

Further, as illustrated in FIG. 5, the wave guide 424 may be positioned proximate the illumination source 418 (e.g., in contact therewith). For example, the wave guide 424 may be adhered or otherwise coupled thereto. Thereby, the wave guide 424 may receive the electromagnetic radiation from the illumination source 418 and output illumination at one or more locations.

For example, as illustrated in FIG. 4, the wave guide 424 may define a longitudinal length extending between a first longitudinal end 438 and a second longitudinal end 440. The first longitudinal end 438 of the wave guide 424 may be coupled to or otherwise positioned proximate the illumination source 418, so that the wave guide may receive electromagnetic radiation from the illumination source. The second longitudinal end 440 of the wave guide 424 may be positioned proximate the second outer body end 428 of the outer body 404. For example, the second longitudinal end 440 of the wave guide 424 may be positioned proximate (e.g., adjacent or in contact with) the end cap 422, so as to illuminate the end cap with light when the illumination source 418 outputs electromagnetic radiation.

The material composition and structural configuration of the wave guide 424 and the mechanisms by which the control body 400 is illuminated by the wave guide and the illumination source 418 may vary. However, while not intending to be limited to one particular mechanism of operation, in general the wave guide 424 may operate by retaining electromagnetic radiation outputted by the illumination source 418 therein, except at selected locations. Thus, the wave guide 424 may be configured to cause substantially total internal reflection except at locations at which light output is desired. In this regard, the wave guide 424 may define multiple materials or material configurations defining differing refractive indices, such that light is emitted from the wave guide at portions thereof defining a relatively lower refractive index than a remaining portion of the wave guide. Further, in some embodiments light may be emitted at locations at which the electromagnetic radiation is directed substantially normally to an outer surface of the wave guide, as a result of such materials being incapable of reflecting electromagnetic radiation that is directed perpendicular to a surface thereof.

By way of example, FIG. 6 schematically illustrates a partial view of the illumination source 418 and the wave guide 424. As illustrated, the wave guide 424 may include a core 442. The illumination source 418 may be coupled to and configured to emit electromagnetic radiation 444 into the core 442 at the first longitudinal end 438 of the wave guide. The core 442 may be configured to internally reflect the electromagnetic radiation 444 such that the electromagnetic radiation is retained therein except at selected locations at which light 446 (e.g., visible light) is outputted. In this regard, the wave guide 424 may further comprise refractors 448, which may refract the electromagnetic radiation 444 out of the wave guide 424 as the light 446.

In some embodiments the core 442 may comprise silicone rubber. Usage of silicone rubber may provide the core 442 with a relatively high degree of transparency, to improve light emission efficiency. Further, silicone rubber may be flexible so as to allow for manipulation of the wave guide 424 into a desired shape. For example, the wave guide 424 may be bent or rolled into a substantially tubular configuration in some embodiments, wherein the electromagnetic radiation 444 is directed along the longitudinal length thereof. However, the core 442 may comprise various other materials in other embodiments, which may preferably be substantially transparent and flexible as noted above. Examples of such materials include polymethyl methacrylate (PMMA), polyethylene terephthalate (PET), polycarbonate, polyvinyl chloride (PVC), polypropylene, or any flexible and substantially transparent or translucent material.

In some embodiments the refractors 448 may comprise printed ink (e.g., white ink). Thereby, the refractors 448 may be printed (e.g., screen printed) onto the core 442 to define a desired pattern of illumination. In an alternate embodiment, the refractors may comprise areas at which the core is roughened to cause light to exit therefrom. For example, the core may be etched (e.g., chemical or laser etched) at areas where light emission is desired. Alternatively, the refractors may comprise discrete prismatic structure embossed or molded to or within the core. Regardless of the particular embodiment of refractors 448 employed, the refractors may direct light outwardly from the wave guide 424 at the selected positions at which the refractors are located to illuminate the control body 400.

Wave guides including a silicone rubber core with printed refractors are available from Fuji Polymer Industries, Co. of Nagoya, Japan. Additionally, wave guides formed by roll-to-roll transfer methods are available from Planetech International of Irvine, Calif. Further, PCT Pat. App. Pub. No. WO2012006854 to Chen et al. discloses a roll-to-roll transfer method for producing wave guides, which is incorporated herein by reference in its entirety.

Note that the embodiment of the wave guide illustrated in FIG. 6 is provided for example purposes only. Thus, while the wave guide is illustrated as including a core comprising a solid, integral substrate, various other embodiments of wave guides may be employed. For example, embodiments of wave guides may include a plurality of fiber optic strands or a fluid core enclosed within a sheath. With respect to embodiments including a fluid core, the fluid core may transport electromagnetic radiation generally in the same manner described above with respect to wave guides including a solid core. In this regard, the fluid core may define a relatively higher refractive index than the sheath surrounding the fluid core, so that electromagnetic radiation is retained within the fluid core except at locations at which refractors defining a relatively lower refractive index are positioned. Usage of a wave guide including a liquid core may desirable in that the wave guide may be flexible when employed in conjunction with a flexible sheath or tube, which may comprise, by way of example, plastic or rubber. Thereby, the wave guide may be configured in a desired shape in a manner similar to that of the above-described flexible, solid core. Example embodiments of wave guides including a fluid core are available from Lumatec of Deisenhofen, Germany.

In some embodiments the illumination source may be configured to output the electromagnetic radiation in the visible spectrum. In this regard, the electromagnetic radiation may define substantially the same wavelength as the light exiting the wave guide. In this embodiment, as a result of the wave guide receiving and emitting light having a wavelength in the visible spectrum, the wave guide may be also be referred to as a light guide.

However, in other embodiments the wave guide may be configured to alter a wavelength of the electromagnetic radiation received from the illumination source. In this regard, by way of example, the wave guide may include an energy conversion material configured to alter a wavelength of the electromagnetic radiation such that the light exiting the wave guide is within the visible spectrum. Example embodiments of energy conversion materials are disclosed in U.S. Pat. No. 7,132,785 to Ducharme, which is incorporated herein by reference in its entirety. Regardless of whether or not the wave guide 424 employs an energy conversion material, in some embodiments the illumination source 418 may comprise one or more light emitting diodes (LEDs). Usage of light emitting diodes may be preferable in that light emitting diodes may produce electromagnetic radiation relatively efficiently with a relatively small amount of energy being wasted as heat. For example, light emitting diodes may be relatively more efficient at producing electromagnetic radiation in comparison to incandescent bulbs.

As illustrated in FIG. 6, in some embodiments the wave guide 424 may be received within (i.e., inside) the outer body 404. Accordingly, the outer body 404 may include features configured to allow the light 446 to exit the control body 400. By way of example, in some embodiments the outer body 404 may be translucent or transparent, such that light may be directed therethrough at any desired location. Alternatively or additionally, as illustrated, the control body may include one or more apertures 450 defined therethrough. Thereby, the light may exit the outer body 404 through the apertures 450 defined therethrough.

However, as further illustrated in FIG. 6, in some embodiments the control body 400 may further comprise a label 452, which may be positioned outside of the outer body 404. In this embodiment, the label 452 or a section thereof may be translucent or transparent to allow the light 446 to travel therethrough. Alternatively, as illustrated, the label 452 may include apertures 454 defined therethrough. The apertures 454 defined through the label 452 may be aligned with the apertures 450 defined through the outer body 404 to allow the light 446 to exit the control body 400.

Further, to the extent that some of the electromagnetic radiation 444 is directed perpendicularly to an outer surface of the core 442, light 446 may also emitted at such surfaces. For example, light 446 may be emitted at the second longitudinal end 440 of the wave guide 424, which may thereby illuminate the end cap 422. Accordingly the wave guide 424 may receive the electromagnetic radiation 444 and transmit the electromagnetic radiation to one or more illumination sections to illuminate the control body 400. In this regard, as described above, in some embodiments the wave guide may be configured output light 446 at the second longitudinal end 440 of the wave guide 424. Note that providing the wave guide 424 with a substantially tubular configuration in which the wave guide extends around substantially an entirety of an inner circumference of the outer body 404 may allow the wave guide to illuminate substantially an entirety of the end cap 422. Thereby, for example, the end cap 422 may simulate the lit end of a cylindrical smoking article such as a cigarette.

Further, the wave guide 424 may be configured to output light 446 at an intermediate illumination section 455 at which the refractor(s) 448 direct light 446 therefrom. The intermediate illumination section 455 may be positioned between the first longitudinal end 438 and the second longitudinal end 440 of the wave guide 424. For example, the refractors 448 may be configured to cause the intermediate illumination section 455 to display a logo or a graphic, and/or output information to a user. Further, as may be understood, multiple intermediate illumination sections may be employed in some embodiments by positioning refractors 448 at any of various locations at which output of light 446 is desired.

The shape of the wave guide 424 may vary. In this regard, in some embodiments the wave guide 424 may define a hollow, substantially tubular configuration. In other words, the wave guide 424 may extend about and define a cavity 456, as illustrated in FIG. 4. Usage of a hollow, substantially tubular configuration may allow for receipt of various other components of the control body 400 inside the cavity 456 about which the wave guide 424 extends. For example, the electrical power source 416 may be received in the cavity 456.

Various embodiments of the wave guide 424 are described below. These wave guides 424 may include some or all of the features described above. However, the embodiments of the wave guide 424 may include differing shapes, as detailed below.

In this regard, FIGS. 7-9 illustrate a first embodiment of the wave guide 424', wherein the wave guide defines a substantially tubular configuration wherein the wave guide is substantially cylindrical and hollow. In particular, FIG. 7 illustrates a side view of the wave guide 424' in a bent configuration. FIG. 8 illustrates a view of the first longitudinal end 438 of the wave guide 424' and the first outer body end 426 of the outer body 404, wherein the wave guide is in the bent configuration and received within the outer body. FIG. 9 illustrates a top view of the wave guide 424' in both planar and bent configurations.

The wave guide 424' may define a shape that matches the shape of a surface of the outer body 404. For example, the wave guide 424' may define a shape that matches an inner surface 458 of the outer body 404 (see, FIG. 5). As such, in embodiments in which the outer body 404 defines a substantially tubular configuration, the wave guide 424' may also define a substantially tubular configuration.

In some embodiments the wave guide may define a continuous cross-section perpendicular to a longitudinal length thereof, such that there are no breaks or gaps around the circumference of the wave guide. However, in other embodiments the wave guide 424' may define one or more joints about the circumference thereof. For example, the wave guide 424' may define a single piece construct with a joint 460 (see, FIG. 8) positioned between a first lateral end 462 and a second lateral end 464 (see, FIG. 9) of the wave guide. Alternatively, the first and second lateral ends 462, 464 may overlap one another. In some embodiments the wave guide 424' may be rigid and/or otherwise permanently configured in the substantially-tubular configuration with the lateral ends 462, 464 thereof positioned next to each other (e.g. in abutting contact) at the joint 460 or overlapping.

However, in other embodiments the wave guide 424' may be flexible. For example, as illustrated in dashed outline in FIG. 9, the wave guide 424' may define a substantially planar configuration prior to insertion into the outer body 404. In this regard, the wave guide 424' may comprise a relatively thin sheet of material that is bent (e.g., wrapped) into a desired configuration. Thus, for example, a plurality of the wave guides 424' may be cut from a sheet of material. Thereby, rapid production of the wave guides 424' may be facilitated.

The wave guide 424' may be bent by folding the lateral ends 462, 464 toward one another, and the folded wave guide 424' may be inserted into the outer body 404. In one embodiment the wave guide 424' may be wrapped around the electrical power source 416, and the wave guide and the electrical power source may be simultaneously inserted into the outer body 404 so as to facilitate placement of the wave guide in the proper position and improve assembly efficiency. However, in other embodiments the wave guide 424' may be inserted into the outer body 404 before or after the electrical power source 416 is inserted into the outer body 404.

Once inserted, the wave guide 424' may resiliently press against the inner surface 458 of the outer body 404 (see, e.g., FIG. 8) such that the wave guide engages and extends around at least a portion of the inner periphery of the outer body. For example, the wave guide 424' may extend around at least a portion of an inner circumference of the outer body 404 defined by the inner surface 458 in embodiments in which the outer body defines a tubular configuration. Thus, in one embodiment the wave guide 424' may define a substantially planar, rectangular configuration prior to insertion into the outer body 404 and a substantially tubular configuration following insertion into the outer body.

In some embodiments the width of the wave guide 424' may be substantially equal to the inner circumference defined at the inner surface 458 of the outer body 404 in embodiments in which the outer body is at least partially hollow. Thereby, the lateral ends 462, 464 of the wave guide 424' may abut one another at the joint 460. Alternatively, the wave guide 424' may define a width greater than the inner circumference of the outer body 404 at the inner surface 458. In this embodiment the lateral ends 462, 464 of the wave guide 424' may overlap in the bent configuration. By providing the wave guide 424' with a width greater than or equal to the inner circumference of the outer body 404, the light 446 emitted from the wave guide may illuminate the end cap 422 about the circumference thereof.

Accordingly, the embodiment of the wave guide 424' described above may define a rectangular configuration prior to bending and assembly. However, the wave guide 424 may define various other shapes in other embodiments. For example, in some embodiments the wave guide 424 may define configurations configured to reduce material usage. In this regard, reducing the amount of material employed to form the wave guide 424 may reduce the costs associated therewith. Further, the shape of the wave guide 424 may be particularly configured to reduce the amount of space occupied by the wave guide. In this regard, the wave guide 424 may extend around the electrical power source 416 (see, e.g., FIG. 4), and hence it may be desirable to reduce the volume of space within the outer body 404 occupied by the wave guide so as to allow for usage of a relatively larger power source or to allow for a reduction in the overall dimensions of the control body 400.

Although reduction in the size of the wave guide 424 may be desirable, such a reduction in size may adversely affect the illumination characteristics of the control body 400. In this regard, if the length of the wave guide 424 between the first longitudinal end 438 and the second longitudinal end 440 is reduced while retaining the dimensions of other components, a gap may be located between the second longitudinal end of the wave guide and the end cap 422 (see, e.g., FIG. 4), which may adversely affect the efficiency of transmission of light 446 to and through the end cap. Conversely, if the wave guide 424 defines a shortened length between the first longitudinal end 438 and the second longitudinal end 440 with the second longitudinal end positioned in contact with the end cap 422, engagement of the illumination source 418 with the wave guide may be complicated. For example, engagement of the illumination source 418 with the wave guide 424 may require extending the length of the control component 412, which may negate space saving gains associated with reducing the longitudinal length of the wave guide. Alternatively, if a gap is positioned between the wave guide 424 and the illumination source 418, such that there is not engagement therebetween, the amount of electromagnetic radiation (see, FIG. 6) received by the first longitudinal end 438 of the wave guide 424 and directed to the second longitudinal end 440 thereof may be reduced, such that the light emission efficiency is decreased.

Accordingly, embodiments of the wave guide 424 of the present disclosure may include dimensions that are reduced in directions other than along a longitudinal length thereof extending between the first and second longitudinal ends 438, 440. In this regard, the wave guide 424 may define a width extending transversely relative to the longitudinal length. In some embodiments the wave guide 424 may define reduced lateral dimensions across the width thereof.

However, as described above, in some embodiments it may be desirable to provide the wave guide 424 with a tubular configuration such that the wave guide may provide a circular ring of light to substantially fully illuminate the end cap 422 and, for example, mimic the lit end of a cigarette. Thus it may be desirable to provide the second longitudinal end 440 of the wave guide 424 with sufficient width so as to extend around substantially the entirety of the inner perimeter of the outer body 404 at the inner surface 458. However, it may still be desirable to reduce the volume occupied by the wave guide 424 within the cavity 456 defined by the outer body 404 and reduce the amount of material employed to form the wave guide. Thus, in some embodiments the wave guide 424 may define a width at the second longitudinal end 440 that is greater than a width at the first longitudinal end 438.

In embodiments in which the wave guide 424 is flexible and bent prior to insertion into the outer body 404, the width of the wave guide at the second longitudinal end 440 may be greater than that of the first longitudinal end 438 before being bent (e.g., while the wave guide defines a substantially flat, planar configuration). Further, in some embodiments the second longitudinal end 440 of the wave guide 424 may still be wider than the first longitudinal end 438 of the wave guide after being bent. For example, the second longitudinal end 440 of the wave guide 424 may define a width in the bent configuration substantially equal to that of the inner diameter of the outer body 404. Thereby, in embodiments in which the first longitudinal end 438 of the wave guide 424 defines an unbent width (e.g., a flat, planar width) that is less than the inner diameter of the outer body 404, the width of the wave guide at the second longitudinal end 440 may be greater than the width of the first longitudinal end of the wave guide in the bent configuration.

Accordingly, as described above, usage of a wave guide 424 wherein the second longitudinal end 440 defines a greater width than the first longitudinal end 438 may provide various benefits by reducing the volume occupied by the wave guide 424 within the cavity 456 defined by the outer body 404 and/or reducing the amount of material employed to form the wave guide. The wave guide 424 may define various shapes wherein the second longitudinal end 440 thereof defines a width that is greater than a width of the first longitudinal end 438.

In this regard, FIGS. 10-12 illustrate a wave guide 424" according to an additional example embodiment of the present disclosure. In particular, FIG. 10 illustrates a side view of the wave guide 424" in a bent configuration. FIG. 11 illustrates a view of the first longitudinal end 438 of the wave guide 424" and the first outer body end 426 of the outer body 404, wherein the wave guide is in the bent configuration and received within the outer body. FIG. 12 illustrates a top view of the wave guide 424" in both planar and bent configurations.

For brevity purposes, only aspects of the wave guide 424" of FIGS. 10-12 that differ from the wave guide 424' of FIGS. 7-9 are described herein. In this regard, the wave guide 424" may embody and include any of the features of the embodiments of the wave guide described above, except as otherwise noted hereinafter. In this regard, the wave guide 424" may define a shape differing from that of the embodiment of the wave guide 424' described above.

In particular, as illustrated in FIG. 12, the wave guide 424" may define a T-shape. The wave guide 424" may include a longitudinal body portion 466 and a lateral body portion 468 defining the T-shape. The longitudinal body portion 466 may be positioned at, and extend from, the first longitudinal end 438 of the wave guide 424", whereas the lateral body portion 468 may be positioned at the second longitudinal end 440 of the wave guide.

The shape of the wave guide 424 prior to insertion into the outer body 404 is illustrated in dashed outline in FIG. 12. In this regard, the wave guide 424" may initially define a substantially flat, planar configuration prior to bending and insertion into the outer body 404. Further, as illustrated in solid outline in FIG. 12, in some embodiments the wave guide 424" may retain the T-shape following bending, when viewed from above. In this regard, the longitudinal body portion 466 may define a width that is less than a diameter of the outer body 404. Thereby, as described above, the width of the wave guide 424" at the second longitudinal end 440 may be greater than the width of the wave guide at the first longitudinal end 438 in both the initial substantially flat, planar configuration and the bent configuration in which the wave guide is received in the outer body 404.

Although the longitudinal body portion 466 may define a relatively small width, the longitudinal body portion may still operate in the manner described above. In this regard, the longitudinal body portion 466 of the wave guide 424" may be configured to receive the electromagnetic radiation 444 from the illumination source 418 and transmit the electromagnetic radiation to the lateral body portion 468. Thus, although the longitudinal body portion 466 may define a relatively small width, by being positioned in engagement and in alignment with the illumination source 418, the longitudinal body portion may still receive and transmit the electromagnetic radiation 444 therealong.

Further, the lateral body portion 468 may receive the electromagnetic radiation 444 from the longitudinal body portion 466. Whereas the longitudinal body portion 466 may be generally configured to transmit the electromagnetic radiation 444 longitudinally, the lateral body portion 468 may be generally configured to transmit the electromagnetic radiation laterally. For example, the lateral body portion 468 of the wave guide 424" may define a width configured to extend around substantially an entirety of an inner circumference of the outer body 404 at the inner surface 458, as illustrated in FIG. 11. Thereby, the light 446 may be emitted from the lateral body portion 468 of the wave guide 424" across substantially the entirety of the second longitudinal end 440 thereof. Accordingly, the end cap 422 may be illuminated by directing the light 446 around substantially the entirety of the inner circumference thereof in embodiments in which the lateral body portion 468 of the wave guide 424" at the second longitudinal end 440 extends around substantially an entirety of the inner circumference of the outer body 404.

Accordingly, FIGS. 10-12 illustrate an embodiment of the wave guide 424" wherein the volume occupied by the wave guide is reduced by providing the wave guide with a T-shape configuration in which the longitudinal body portion 466 defines a reduced width as compared to the lateral body portion 468. While such a configuration may succeed in reducing the amount of material employed to form the wave guide 424" and also the volume occupied within the cavity 456 defined by the outer body 404, such a configuration may result in an uneven distribution of the light 446 exiting the wave guide. In this regard, although the longitudinal body portion 466 may transmit the light to the lateral body portion 468, the light 446 exiting the lateral body portion 468 may be concentrated at a section aligned with the longitudinal body portion. Thus, the end cap 422 may be illuminated more brightly at a portion thereof that is also aligned with the longitudinal body portion 466 of the wave guide 424".

However, it may be desirable to substantially evenly illuminate the end cap 422 about the circumference thereof. In this regard, FIGS. 13-15 illustrate a wave guide 424''' according to an additional example embodiment of the present disclosure. In particular, FIG. 13 illustrates a side view of the wave guide 424''' in a bent configuration. FIG. 14 illustrates a view of the first longitudinal end 438 of the wave guide 424''' and the first outer body end 426 of the outer body 404, wherein the wave guide is in the bent configuration and received within the outer body. FIG. 15 illustrates a top view of the wave guide 424''' in both planar and bent configurations.

For brevity purposes, only aspects of the wave guide 424''' of FIGS. 13-15 that differ from the embodiments of the wave guide 424', 424" of FIGS. 7-12 are described herein. In this regard, the wave guide 424''' may embody and include any of the features of the embodiment of the wave guide described above, except as described hereinafter. As described hereinafter, the wave guide 424' may define a shape that differs from the above-described embodiments of the wave guide.

In particular, as illustrated in FIG. 15, the wave guide 424' may define a truncated triangular shape prior to insertion into the outer body 404 (i.e. when configured in a substantially flat, planar configuration). In this regard, the wave guide 424''' may be truncated at the first longitudinal end 438, such that the first longitudinal end of the wave guide is configured for engagement with the illumination source 418. Thus, as illustrated, the width of the wave guide 424''' may increase from the first longitudinal end 438 to the second longitudinal end 440 thereof. As further illustrated, in some embodiments the width of the wave guide 424''' may substantially continuously increase from the first longitudinal end 438 to the second longitudinal end 440 thereof.

Further the first lateral end 462 and the second lateral end 464 of the wave guide 424' may meet at a point 470 in the bent, assembled configuration, as illustrated in FIG. 14. In this embodiment the width of the wave guide 424' at the second longitudinal end 440 may be substantially equal to the inner circumference of the outer body 404 at the inner surface 458 thereof. Alternatively, as noted above, the first lateral end 462 and the second lateral end 464 may overlap one another. In this embodiment the width of the second lateral end 462 of the wave guide 424' may be greater than the inner circumference of the outer body 404.

The wave guide 424''' may thus be configured such that the electromagnetic radiation 444 emitted by the illumination source 418 into the first longitudinal end 438 of the wave guide is transmitted to the second longitudinal end 440 of the wave guide. In particular, the wave guide 424' may be configured to directly transmit the electromagnetic radiation 444 across the entirety of the width of the second longitudinal end 440 of the wave guide. In this regard, by providing the wave guide with a shape in which the width thereof continuously increases from the first longitudinal end 438 to the second longitudinal end 440, the wave guide may directly transmit the electromagnetic radiation 444 along the entirety of the width of the second longitudinal end thereof. In contrast, the wave guide 424'' illustrated in FIGS. 10-12 directly transmits the electromagnetic radiation to a portion of the second longitudinal end of the wave guide having a width substantially equal to the width of the longitudinal body portion 466. Thus, the embodiment of the wave guide 424' illustrated in FIGS. 13-15 may more evenly output the light 466 across the second longitudinal end 440 thereof, such that the end cap 422 may be more evenly illuminated.

FIGS. 16-18 illustrate a wave guide 424'''' according to an additional example embodiment of the present disclosure. In particular, FIG. 16 illustrates a side view of the wave guide 424'''' in a bent configuration. FIG. 17 illustrates a view of the first longitudinal end 438 of the wave guide 424'''' and the first outer body end 426 of the outer body 404, wherein the wave guide is in the bent configuration and received within the outer body. FIG. 18 illustrates a top view of the wave guide 424'''' in both planar and bent configurations.

As illustrated in FIG. 18, the wave guide 424'''' may define a truncated triangular configuration. The wave guide 424'''' is truncated at the first longitudinal end 438 as described above with respect to the embodiment of the wave guide 424''' illustrated in FIGS. 13-15. However, the wave guide 424'''' may also be truncated at the second longitudinal end 440. Thus, as illustrated, the wave guide 424'''' may define a truncated triangular configuration, wherein each of the corners of the triangle is missing/removed.

As a result of the truncation of the corners of the wave guide 424'''' at the second longitudinal end 440, the wave guide 424 may define an end section 472 (see, e.g., FIG. 18) defining a substantially constant width between the first lateral end 462 and the second lateral end 464 along the length thereof. The width of the end section 472 may be at least equal to an inner circumference of the outer body 400 such that the first lateral end 462 and the second lateral end 464 may abut at the joint 460 or overlap to annularly output the light 446.

The wave guide 424'''' may be configured to directly transmit the electromagnetic radiation 444 across the entirety of the width of the second longitudinal end 440 of the wave guide in the manner described above with respect to the wave guide 424''' of FIGS. 13-15. In this regard, by providing the wave guide with a shape in which the width thereof continuously increases from the first longitudinal end 438 to the start of the end section 472, which defines a constant width, the wave guide may directly transmit the electromagnetic radiation 444 along the entirety of the width of the second longitudinal end thereof. Thereby, the second longitudinal end 440 of the wave guide 424'''' may evenly emit the light 446.

Further, providing the wave guide with the end section 472 defining a substantially constant width may facilitate assembly of the control body 400. In this regard, as illustrated in FIG. 18, the first lateral end 462 and the second lateral end 464 may be parallel to one another, such that the first lateral end and the second lateral end may securely meet at the joint 460 (see, FIG. 17). Thereby, it may be easier to properly align the wave guide 424'''' along the longitudinal length of the outer body 404 as compared to the embodiment of the wave guide 424''' illustrated in FIGS. 13-15, wherein the first lateral end and the second lateral end meet at the point 470, which may be less stable.

In summary each of the embodiments of the wave guide 424', 424'', 424''', 424'''' described above may be configured for engagement with an outer body 404. For example, the wave guide 424', 424'', 424''', 424'''' may be flexible, such that the wave guide may be bent into a substantially tubular configuration and inserted into the outer body 404. The wave guide 424', 424'', 424''', 424'''' may extend around substantially an entirety of the inner circumference of the outer body 404 such that the first lateral end 462 abuts or overlaps the second lateral end 464 along at least a portion of the longitudinal length of the wave guide. The wave guide 424', 424'', 424''', 424'''' may define an outer diameter substantially equal to an inner diameter of the outer body 404 as a result of being positioned in contact therewith.

The embodiments of the wave guide 424'', 424''', 424'''' illustrated in FIGS. 10-18 may define a reduced width perpendicular to a longitudinal length thereof. This configuration may employ less material to form the wave guide 424'', 424''', 424', and the wave guide may occupy less space within the control body 400. The embodiments of the wave guide 424''', 424'''' illustrated in FIGS. 13-18 may define an increasing width extending from the first longitudinal end 438 towards the second longitudinal end 440, so as to allow for direct transmission of light across the full width of the wave guide at the second longitudinal end. The embodiment of the wave guide 424'''' illustrated in FIGS. 16-18 may facilitate alignment of the wave guide within the control body 400 by allowing for abutting contact between the first lateral end 462 and the second lateral end 464 thereof.

Note that while the wave guide 424 is generally described and illustrated herein as being positioned inside the outer body 404, in other embodiments the wave guide may be positioned outside of the outer body. For example, the wave guide may be wrapped around the exterior of the outer body instead of the label, or the wave guide may be wrapped around the outer body and the label may be wrapped around the wave guide. In another embodiment the outer body may comprise the wave guide, and the wave guide may serve to both enclose and protect various other components of the control body and provide illumination.

A method for assembling an aerosol delivery device is also provided. As illustrated in FIG. 19, the method may include coupling an illumination source to a first longitudinal end of a wave guide at operation 502. The wave guide may define a longitudinal length extending between the first longitudinal end and a second longitudinal end, and a width extending transversely to the longitudinal length between a first lateral end and a second lateral end. The wave guide may be configured to receive the electromagnetic radiation from the illumination source and output light at one or more illumination sections. Further, the method may include inserting the wave guide within an outer body at operation 504. The outer body may be at least partially hollow and define an inner circumference, such that the wave guide extends around substantially an entirety of the inner circumference of the outer body and the first lateral end abuts or overlaps the second lateral end along at least a portion of the longitudinal length of the wave guide.

The method may further comprise bending the wave guide. The width of the wave guide may be greater at the second longitudinal end than at the first longitudinal end. Bending the wave guide may include abutting or overlapping the first lateral end and the second lateral end at the second longitudinal end of the wave guide. Bending the wave guide may include bending the wave guide from a T-shape. Bending the wave guide may include bending the wave guide from a truncated triangular shape. Bending the wave guide may include wrapping a sheet of material into a substantially tubular configuration such that the wave guide defines an outer diameter substantially equal to an inner diameter of the outer body.

The method may further comprise inserting an electrical power source and a control component within the outer body. The control component may be configured to direct current from the electrical power source to an atomizer. The method may additionally include coupling a coupler to a first outer body end and coupling an end cap to a second outer body end such that the second longitudinal end of the wave guide is positioned proximate the end cap. Further, the method may include coupling the coupler to a cartridge.

In some embodiments inserting the wave guide within the outer body at operation 504 may include resiliently pressing the wave guide against the inner circumference of the outer body. Coupling the illumination source to the first longitudinal end of the wave guide at operation 502 may include orienting the illumination source perpendicularly to the second longitudinal end of the wave guide such that the one or more illumination sections include the second longitudinal end. Further, the method may include engaging a refractor with a core of the wave guide between the first longitudinal end and the second longitudinal end of the wave guide to define an intermediate illumination section.

Many modifications and other embodiments of the disclosure will come to mind to one skilled in the art to which this disclosure pertains having the benefit of the teachings presented in the foregoing descriptions and the associated drawings. Therefore, it is to be understood that the disclosure is not to be limited to the specific embodiments disclosed herein and that modifications and other embodiments are intended to be included within the scope of the appended claims. Although specific terms are employed herein, they are used in a generic and descriptive sense only and not for purposes of limitation.

The invention claimed is:

1. An aerosol delivery device, comprising:

an outer body extending between a first outer body end and a second outer body end, the outer body being at least partially hollow;

an illumination source configured to output an electromagnetic radiation; and a wave guide disposed within the outer body, the wave guide comprising a length extending between a first longitudinal end and a second longitudinal end and a width extending between a first lateral end and a second lateral end, wherein the wave guide is bent into a defined shape for placement within the outer body and extends from the illumination source to one or more illumination sections disposed about an outside portion of the outer body, and wherein the wave guide is configured to receive the electromagnetic radiation from the illumination source and output light at the one or more illumination sections.

2. The aerosol delivery device of claim 1, wherein the width of the wave guide is greater at the second longitudinal end than at the first longitudinal end.

3. The aerosol delivery device of claim 1, wherein the wave guide defines a T-shape prior to insertion within the outer body.

4. The aerosol delivery device of claim 1, wherein the wave guide defines a truncated triangular shape prior to insertion into the outer body.

5. The aerosol delivery device of claim 1, further comprising an electrical power source and a control component, the control component being configured to direct current from the electrical power source to an atomizer.

6. The aerosol delivery device of claim 1, wherein the wave guide is flexible.

7. The aerosol delivery device of claim 6, wherein the wave guide comprises a sheet of material wrapped into a substantially tubular configuration, the wave guide defining an outer diameter substantially equal to an inner diameter of the outer body.

8. The aerosol delivery device of claim 1, further comprising a coupler coupled to the first outer body end; and an end cap coupled to the second outer body end, the second longitudinal end of the wave guide being positioned proximate the end cap.

9. The aerosol delivery device of claim 8, further comprising a cartridge, wherein the outer body, the coupler, the end cap, the illumination source, and the wave guide collectively define a control body, the cartridge being configured to engage the coupler of the control body.

10. The aerosol delivery device of claim 1, wherein the one or more illumination sections include the second longitudinal end of the wave guide.

11. The aerosol delivery device of claim 10, wherein the one or more illumination sections include an intermediate illumination section positioned between the first longitudinal end and the second longitudinal end of the wave guide.

12. A method for assembling an aerosol delivery device, the method comprising:

coupling an illumination source configured to output an electromagnetic radiation to a first longitudinal end of a wave guide, the wave guide extending between the first longitudinal end and a second longitudinal end, the wave guide being configured to receive the electromagnetic radiation from the illumination source and output light at one or more illumination sections;

bending the wave guide; and inserting the wave guide within an outer body, the outer body being at least partially hollow, such that the wave guide extends from the illumination source to the one or more illumination sections disposed about an outside portion of the outer body.

13. The method of claim 12, wherein the wave guide has a width extending between a first lateral end and a second lateral end and transversely to a longitudinal length extending between the first longitudinal end and the second longitudinal end, and wherein the width of the wave guide is greater at the second longitudinal end than at the first longitudinal end and wherein bending the wave guide comprises abutting or overlapping the first lateral end and the second lateral end at the second longitudinal end of the wave guide.

14. The method of claim 13, wherein bending the wave guide comprises bending the wave guide from a T-shape.

15. The method of claim 13, wherein bending the wave guide comprises bending the wave guide from a truncated triangular shape.

16. The method of claim 12, wherein bending the wave guide comprises wrapping a sheet of material into a substantially tubular configuration such that the wave guide defines an outer diameter substantially equal to an inner diameter of the outer body.

17. The method of claim 12, further comprising inserting an electrical power source and a control component within the outer body, the control component being configured to direct current from the electrical power source to an atomizer.

18. The method of claim 12, further comprising coupling a coupler to a first outer body end; and coupling an end cap to a second outer body end such that the second longitudinal end of the wave guide is positioned proximate the end cap.

19. The method of claim 18, further comprising coupling the coupler to a cartridge.

20. The method of claim 14, wherein inserting the wave guide within the outer body comprises resiliently pressing the wave guide against an inner circumference of the outer body.

21. The method of claim 12, wherein coupling the illumination source to the first longitudinal end of the wave guide comprises orienting the illumination source perpendicularly to the second longitudinal end of the wave guide such that the one or more illumination sections include the second longitudinal end.

22. The method of claim 21, further comprising engaging a refractor with a core of the wave guide between the first longitudinal end and the second longitudinal end of the wave guide to define an intermediate illumination section.

23. The aerosol delivery device of claim 2, wherein the first lateral end abuts or overlaps the second lateral end along at least a portion of the longitudinal length of the wave guide.

24. An aerosol delivery device, comprising:

an outer body extending between a first outer body end and a second outer body end, the outer body being at least partially hollow;

an illumination source configured to output an electromagnetic radiation;

a wave guide disposed within the outer body, the wave guide extending between a first longitudinal end and a second longitudinal end and extending from the illumination source to one or more illumination sections disposed about an outside portion of the outer body, wherein the wave guide is configured to receive the electromagnetic radiation from the illumination source and output light at the one or more illumination sections;

a coupler coupled to the first outer body end; and an end cap coupled to the second outer body end, the second longitudinal end of the wave guide being positioned proximate the end cap.

* * * * *